US010188261B2

(12) United States Patent
Hong et al.

(10) Patent No.: US 10,188,261 B2
(45) Date of Patent: Jan. 29, 2019

(54) DISH WASHING MACHINE

(71) Applicant: SAMSUNG ELECTRONICS CO., LTD., Suwon-si, Gyeonggi-do (KR)

(72) Inventors: Seung Gee Hong, Suwon-si (KR); Yong Soo Kyong, Seoul (KR); Chan Young Park, Suwon-si (KR); Soo Hyung Yoo, Incheon (KR); Chang Wook Lee, Seoul (KR); Min Ho Jung, Suwon-si (KR); Hyoung Jun Kim, Uiwang-si (KR); Jea Won Lee, Hwaseong-si (KR); Hyun Dong Jung, Seoul (KR); Jae Man Joo, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 594 days.

(21) Appl. No.: 14/230,465

(22) Filed: Mar. 31, 2014

(65) Prior Publication Data

US 2014/0299167 A1 Oct. 9, 2014

(30) Foreign Application Priority Data

Apr. 5, 2013 (KR) ..... 10-2013-0037777
Dec. 31, 2013 (KR) ..... 10-2013-0169463
Feb. 13, 2014 (KR) ..... 10-2014-0016950

(51) Int. Cl.
*A47L 15/42* (2006.01)
*A47L 15/16* (2006.01)
*A47L 15/18* (2006.01)

(52) U.S. Cl.
CPC ..... *A47L 15/4282* (2013.01); *A47L 15/16* (2013.01); *A47L 15/4221* (2013.01); *A47L 15/18* (2013.01)

(58) Field of Classification Search
CPC .. A47L 15/4221; A47L 15/4282; A47L 15/16; A47L 15/18
See application file for complete search history.

(56) References Cited

U.S. PATENT DOCUMENTS 2,236,791 A * 4/1941 Forsberg ..... A47L 15/18 134/172
2,704,084 A 3/1955 James et al.
(Continued)

FOREIGN PATENT DOCUMENTS

CH 577 302 7/1976
CN 101655698 2/2010
(Continued)

OTHER PUBLICATIONS

Canadian Office Action dated Jul. 4, 2016 from Canadian Patent Application No. 2,89,699, 4 pages.
(Continued)

*Primary Examiner* — Michael E Barr
*Assistant Examiner* — Benjamin L Osterhout
(74) *Attorney, Agent, or Firm* — Staas & Halsey LLP

(57) ABSTRACT

A dish washing machine having a structure allowing wash water to be evenly sprayed into a washing tub. The dish washing machine includes a cabinet forming an external appearance of the dish washing machine, a washing tub arranged in the cabinet and allowing dishes to be washed therein, a dish basket arranged in the washing tub to accommodate the dishes, a spray unit to spray wash water into the washing tub, a diversion unit arranged inside a flow passage of wash water to divert the wash water sprayed from the spray unit, and a guide member coupled to one side of the diversion unit to allow the diversion unit to move within the washing tub. As the spray unit and the diversion unit are provided, a dead zone which wash water does not reach may
(Continued)

be eliminated, and divided and intensive washing may be implemented in the washing tub.

20 Claims, 40 Drawing Sheets

(56) References Cited

U.S. PATENT DOCUMENTS

| | | | | |
|---|---|---|---|---|
| 3,067,759 | A * | 12/1962 | Guth | A47L 15/23 134/176 |
| 3,915,182 | A * | 10/1975 | Payne | A47L 15/23 134/176 |
| 7,988,791 | B2 * | 8/2011 | Delgado | A47L 15/22 134/56 D |
| 8,287,660 | B2 * | 10/2012 | Chen | A47L 15/42 134/172 |
| 2006/0060228 | A1 * | 3/2006 | Yoon | A47L 15/4204 134/56 D |
| 2009/0056754 | A1 | 3/2009 | Rolek | |
| 2010/0043840 | A1 | 2/2010 | Kim et al. | |
| 2012/0097200 | A1 * | 4/2012 | Fountain | A47L 15/22 134/56 D |
| 2012/0266924 | A1 * | 10/2012 | Boyer | A47L 15/4221 134/198 |
| 2012/0318389 | A1 * | 12/2012 | Holstein | A47L 15/4221 137/625 |
| 2013/0000762 | A1 * | 1/2013 | Buddharaju | A47L 15/4221 137/605 |
| 2013/0092194 | A1 * | 4/2013 | Carlson | A47L 15/16 134/25.2 |

FOREIGN PATENT DOCUMENTS

| | | |
|---|---|---|
| DE | 1191527 | 4/1965 |
| EP | 0 383 028 | 8/1990 |
| EP | 2 030 556 | 3/2009 |
| FR | 730.058 | 8/1932 |
| FR | 2 627 073 | 8/1989 |
| GB | 490913 | 8/1938 |
| JP | 2008-279137 | 11/2008 |

OTHER PUBLICATIONS

European Search Report dated Dec. 4, 2014 in corresponding European Patent Application No. 14162736.4.

International Search Report dated Jul. 4, 2014 in corresponding International Application No. PCT/KR2014/002880.

European Office Action dated Dec. 2, 2016 in related European Patent Application No. 14 162 736.4.

Canadian Office Action dated May 1, 2017 in Canadian Patent Application No. 2,899,699.

Chinese Patent Application dated Jul. 26, 2017 in Chinese Patent Application No. 201410138215.X.

Canadian Notice of Allowance dated Feb. 1, 2018 in Canadian Patent Application No. 2,899,699.

Turkish Office Action dated Dec. 12, 2017 in Turkish Patent Application No. 2015/09481.

Chinese Office Action dated Mar. 27, 2018 in Chinese Patent Application No. 201410138215.X.

Chinese Office Action dated Jun. 26, 2018 in Chinese Patent Application No. 201410138215.X.

* cited by examiner

DISH WASHING MACHINE

CROSS-REFERENCE TO RELATED APPLICATIONS

This application claims the benefit of Korean Patent Application Nos. 10-2013-0037777, filed on Apr. 5, 2013, 10-2013-0169463 filed on Dec. 31, 2013, and 10-2014-0016950, filed on Feb. 13, 2014, in the Korean Intellectual Property Office, the disclosures of which are incorporated herein by reference.

BACKGROUND

1. Field

Embodiments of the present disclosure relate to a dish washing machine having a structure allowing wash water to be evenly sprayed into a washing tub.

2. Description of the Related Art

A dish washing machine, which generally washes dishes by spraying high-pressure wash water onto dishes, usually performs operations of preliminary washing, main washing, rinsing, and drying. In the preliminary washing, wash water having no detergent introduced into the dish washing machine is sprayed to remove debris from the dishes. In main washing, the dishes are cleaned with detergent introduced into the sprayed wash water from a detergent feeder.

The dish washing machine generally includes a cabinet provided with a washing tub, a pump to generate wash water pressure, a dish basket adapted to retain dishes and installed in the washing tub to be movable forward and backward, and spray units to spray wash water onto the dish basket, and a connection flow passage to connect the pump to the spray unit, and a flow passage switching valve to selectively move the wash water from the pump to multiple spray units. The dishes are washed by the wash water sprayed from the spray unit.

The dish basket includes an upper dish basket arranged at an upper portion of the washing tub, and a lower dish basket arranged at a lower portion of the washing tub.

Conventionally, spray units are positioned at the upper and lower sides of the upper dish basket and at the upper side of the lower dish basket. In the case that the spray units are rotatably arranged, there may be dead zones at the corners of the rectangular washing tub which the sprayed wash water does not reach.

A spray unit having a structure causing the spray unit to rotate with a variable length has been proposed to eliminate dead zones which the wash water does not reach. This structure, which rotates the spray unit through reaction of the spray water pressure may eliminate the dead zones, but it may not achieve the effect of divided or intensive washing only for a specific region.

In addition, there has been proposed a connection structure to connect a spray unit, a drive unit to linearly drive the spray unit, and a flow passage connecting the spray unit and a pump to each other using a link or a flexible hose. However, this structure may produce great loss of pressure in the flow passage, and durability of the flow passage may be low.

In addition, in the case that the spray unit is fixed to the dish basket, the flow passage may be inefficiently disposed, thereby resulting in great loss of pressure in the flow passage and a complex structure of the dish basket.

SUMMARY

Therefore, it is an aspect of the present disclosure to provide a dish washing machine which may eliminate dead zones which the wash water does reach by including a spray unit to spray wash water toward the dish basket and a diversion unit to divert the wash water sprayed from the spray unit.

Additional aspects of the disclosure will be set forth in part in the description which follows and, in part, will be apparent from the description, or may be learned by practice of the disclosure.

Therefore, it is an aspect of the present disclosure to provide a dish washing machine including a cabinet forming an external appearance of the dish washing machine, a washing tub arranged in the cabinet and allowing dishes to be washed therein, a dish basket arranged in the washing tub to accommodate the dishes, a first spray unit and a second spray unit provided on one surface of the washing tub, each of the first spray unit and the second spray unit comprising at least one head group having at least one head, a diversion unit arranged to face the first spray unit and the second spray unit to divert wash water sprayed from at least one of the first spray unit and the second spray unit toward the dish basket, a drive unit to drive the diversion unit to move within the washing tub, and a flow passage switching valve to selectively supply the wash water to at least one of the at least one head group.

The diversion unit may be arranged at at least one of upper, lower and lateral sides of the dish basket to divert the wash water sprayed from the at least one of the first spray unit and the second spray unit toward the dish basket.

The flow passage switching valve may include a base and a plurality of holes formed in the base, wherein whether to open or close a flow passage is determined according to positions of the holes shifted by rotation of the base to selectively supply the wash water to at least one of the at least one head group.

The diversion unit may include at least one concave portion provided to at least one portion of a surface of the diversion unit contacting the wash water sprayed from the at least one of the first spray unit and the second spray unit, the concave portion being concavely formed to divert the wash water toward the dish basket.

At least one part of the concave portion may be provided with a flat surface, and the other part of the concave portion may be provided with a curved surface.

The diversion unit may include a plurality of concave portions causing the wash water to be sprayed at different angles.

The concave portion may include an introduction portion allowing the wash water to be introduced thereinto and a discharge portion allowing the wash water to be sprayed therefrom, wherein the discharge portion comprises a first step portion and a second step portion, the first step portion and the second step portion being stepped with respect to each other.

At least one portion of the diversion unit may be provided with at least one slit to prevent contaminants from being accumulated on the diversion unit.

The dish washing machine may further include a guide member coupled to one side of the diversion unit to allow the diversion unit to move within the washing tub.

The guide member may be arranged on an inner surface of the washing tub to guide movement of the diversion unit.

The guide member may be positioned at an inner side of the washing tub, the guide member being coupled to the diversion unit to support a center portion of the diversion unit.

A balancing member to prevent the diversion unit from being rocked may be coupled to both lateral sides of the diversion unit.

The dish washing machine may further include a holder disposed between and coupled to the diversion unit and the guide member to guide coupling between the diversion unit and the guide member.

A lower surface of the guide member may be provided with an opening to prevent accumulation of contaminants.

The dish washing machine may further include a catch member positioned at one side of the washing tub, the catch member contacting and rotating the diversion unit to change an angle of spray of the wash water.

The dish washing machine may further include a direction switching member to switch movement of the diversion unit between a first direction and a second direction differing from the first direction.

The dish washing machine may further include a power generating unit to drive the diversion unit to move within the washing tub.

The first spray unit and the second spray unit may be fixed to at least one of inner wall surfaces of the washing tub.

Each of the first spray unit and the second spray unit may include the head and a body extending from the head, the body being positioned between the washing tub and the cabinet.

The wash water may be sprayed from the head group such that at least one of spray pressure, wash water temperature and spray time is different between the at least one head group.

The at least one head may be inclined upward such that the wash water is sprayed by a distance greater than or equal to a certain distance.

Each of the first spray unit and the second spray unit may include the at least one head to spray the wash water, and the concave portion comprises at least one region corresponding to the head, wherein each of the at least region is formed to have a different curvature such that the wash water is discharged at a different angle.

It is an another aspect of the present disclosure to provide a dish washing machine including a cabinet forming an external appearance of the dish washing machine, a washing tub arranged in the cabinet and allowing dishes to be washed therein, a dish basket arranged in the washing tub to accommodate the dishes, a first spray head and a second spray head arranged along one surface of the washing tub and a diversion unit extending in a direction corresponding to a direction of extension of a line between the first spray head and the second spray head to divert wash water sprayed from the first spray head and the second spray head, wherein the diversion unit comprises a first region corresponding to the first spray head and a second region corresponding to the second spray head, the second region being stepped with respect to the first region.

The diversion unit may include a concave portion concavely formed to divert the wash water from a first direction to a second direction.

The dish washing machine may further include a drive unit to drive the diversion unit to move between front and rear surfaces of the washing tub, between left and right surfaces of the washing tub, or between upper and lower surfaces of the washing tub.

The drive unit may include at least one guide member coupled to the diversion unit to guide movement of the diversion unit, a power generating unit to drive the diversion unit, a pulley or gear coupled to the power generating unit, and a connection member to connect the pulley or gear to the diversion unit The diversion unit may be moved toward the first spray head and the second spray head by the power generating unit and moved away from the first spray head and the second spray head by pressure of the wash water sprayed from the first spray head and the second spray head.

The first spray head and the second spray head may be grouped into at least one spray unit, wherein the at least one spray unit is disposed inside the washing tub to face each other, and the diversion unit comprises a plurality of concave portions disposed to face each of the at least one spray unit.

The diversion unit may be arranged toward an upper side of the dish basket, and the concave portion is disposed to face the dish basket to divert a flow passage of the wash water toward the dish basket.

The diversion unit may be arranged according to a shape of one surface of the dish basket close to the diversion unit, and the spray unit may be disposed to correspond to a shape of the diversion unit.

The dish washing machine may further include a flow passage switching valve adapted to open or close flow passages to selectively supply the wash water to at least one of the first spray head and the second spray head.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
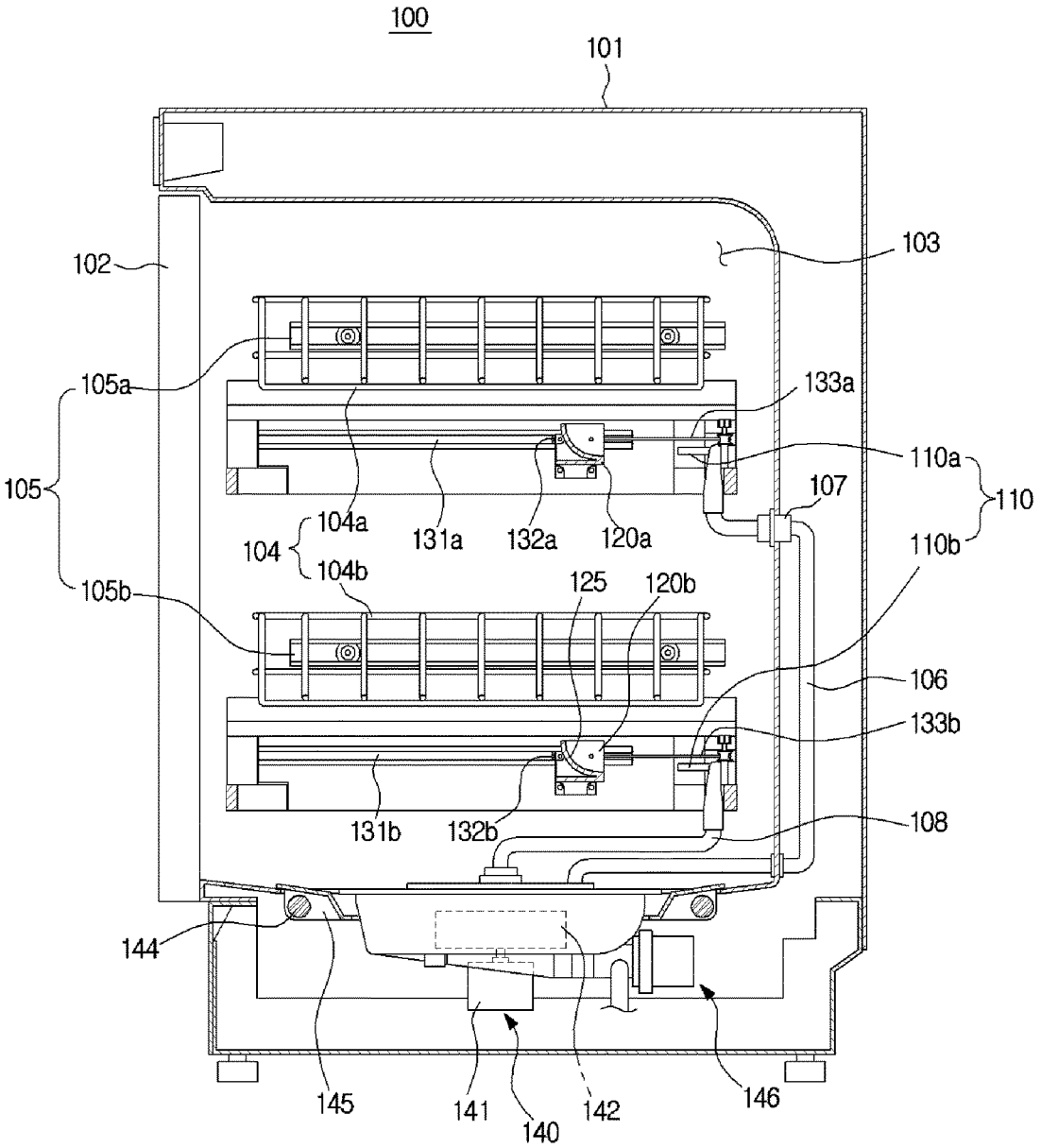
FIG. 1 is a cross-sectional view illustrating the configuration of a dish washing machine according to an embodiment of the present disclosure.

Reference will now be made in detail to the embodiments of the present disclosure, examples of which are illustrated in the accompanying drawings, wherein like reference numerals refer to like elements throughout.

Figure 2:
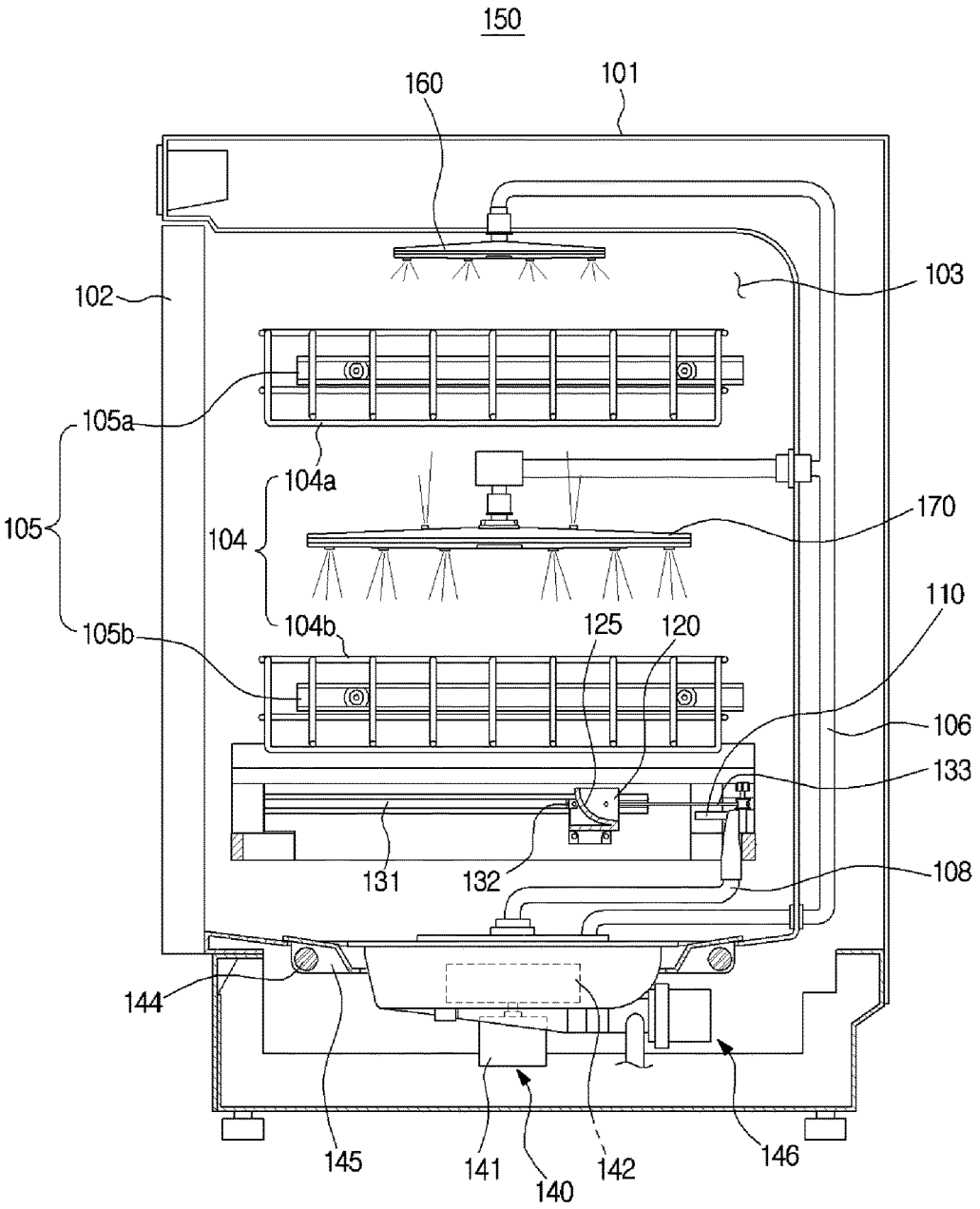
FIG. 2 is a cross-sectional view illustrating the configuration of a dish washing machine according to another embodiment of the present disclosure.
Figure 3:
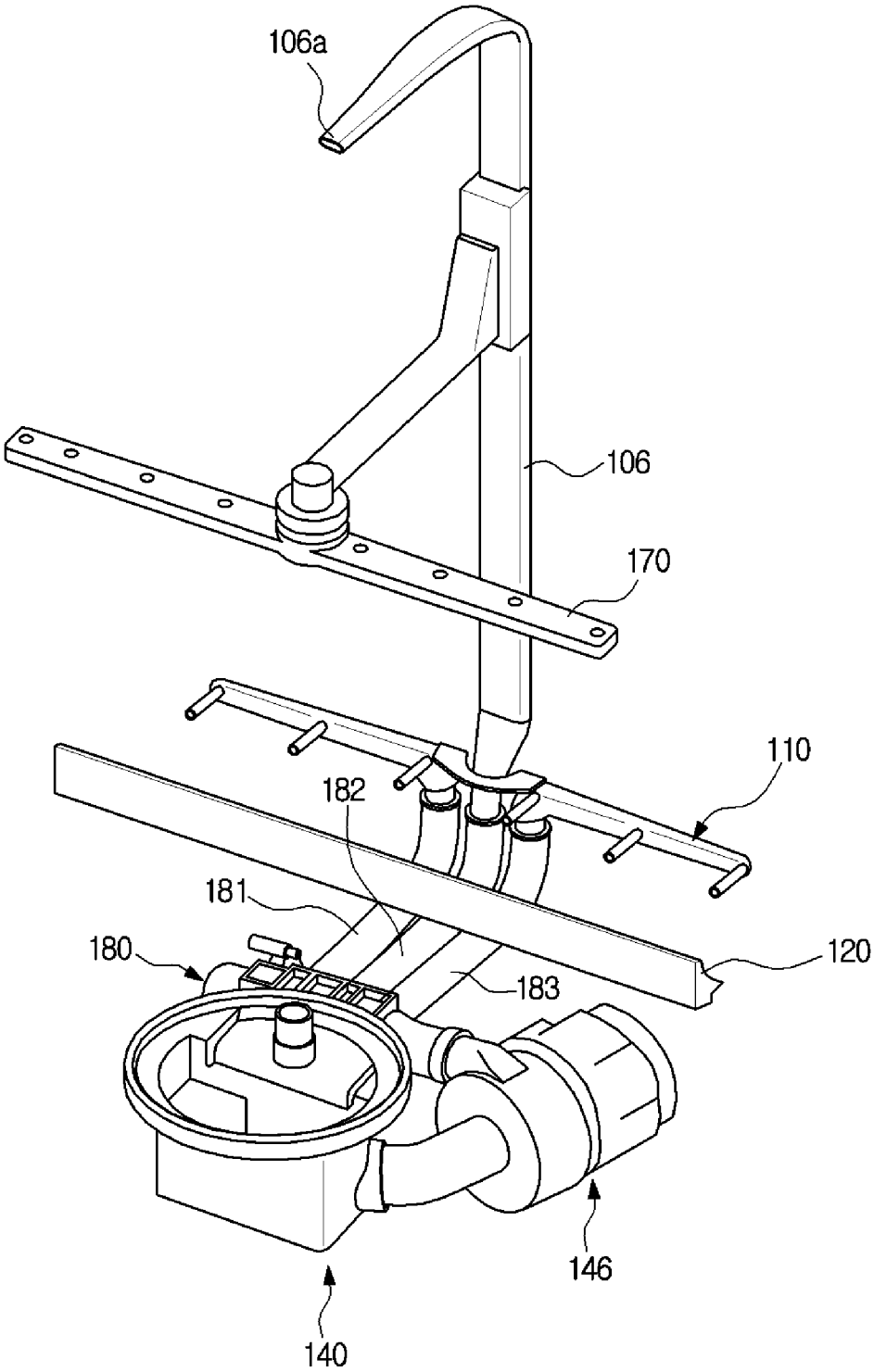
FIG. 3 is a perspective view illustrating some of the constituents of a dish washing machine.
Figure 4:
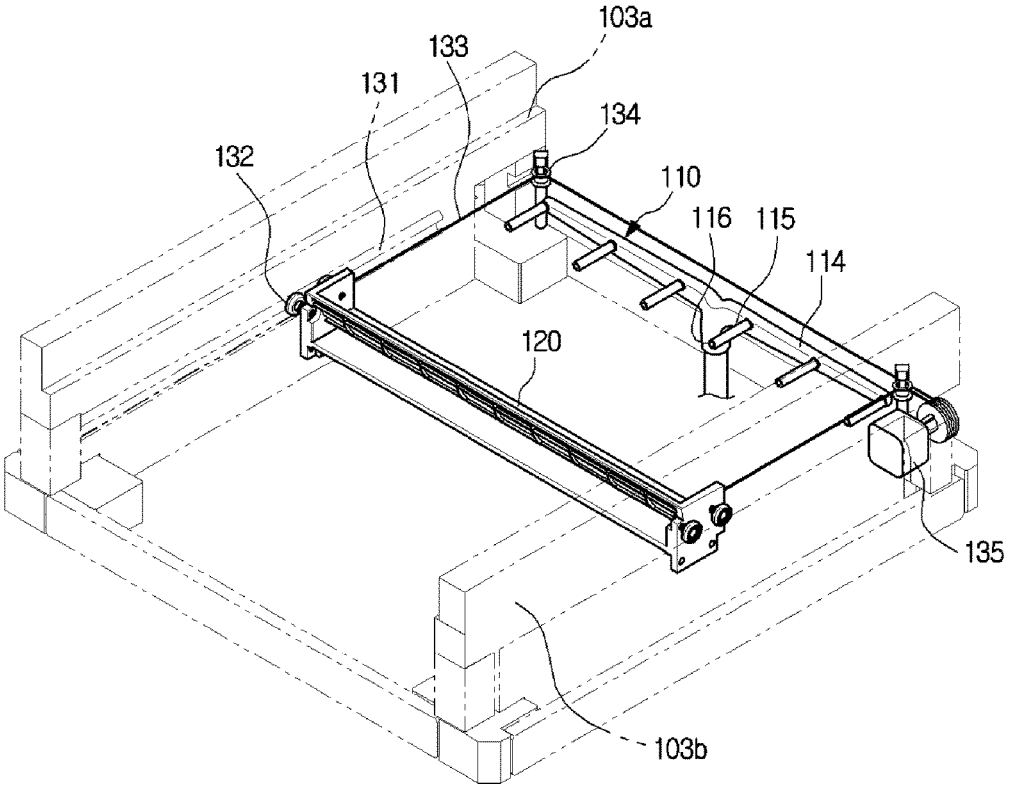
FIG. 4 is a perspective view illustrating a spray unit and diversion unit of a dish washing machine according to one embodiment of the present disclosure.
Figure 5:
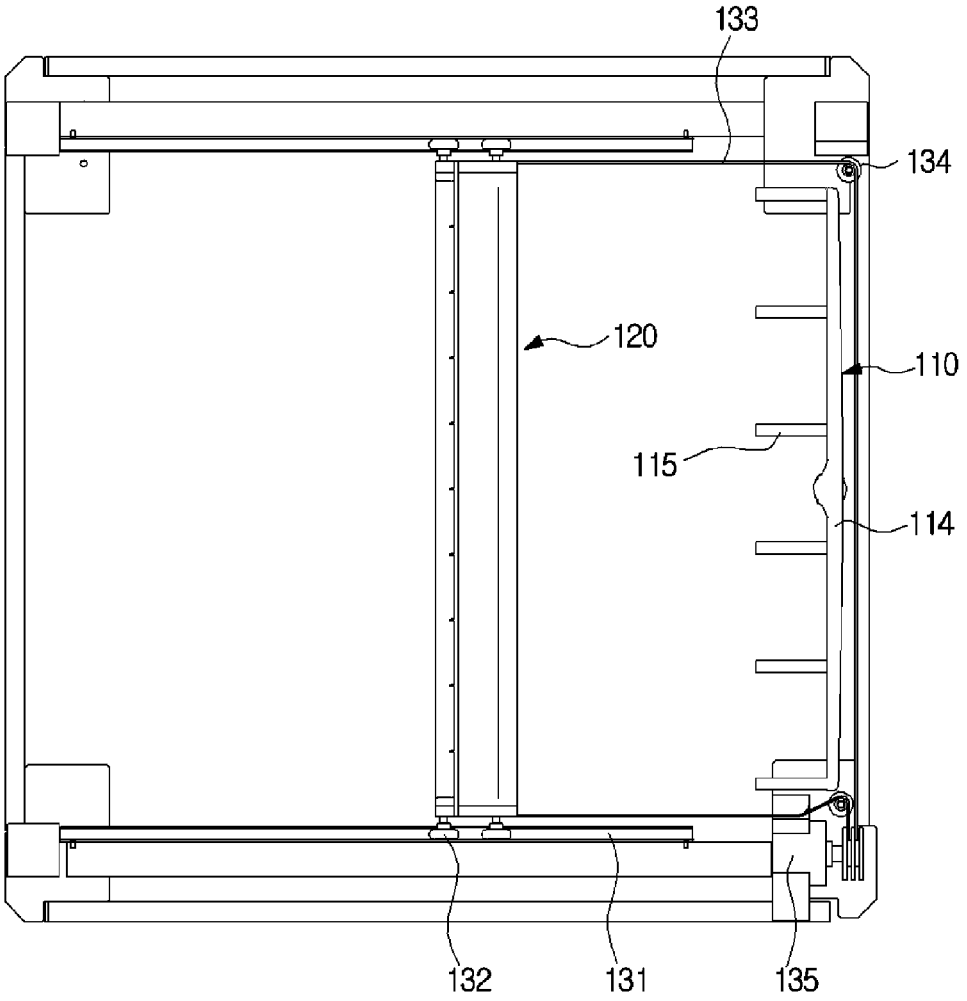
FIG. 5 is a plan view illustrating a spray unit and diversion unit of a dish washing machine according to one embodiment of the present disclosure.

FIG. 1 is a cross-sectional view illustrating the configuration of a dish washing machine according to an embodiment of the present disclosure. FIG. 2 is a cross-sectional view illustrating the configuration of the dish washing machine. FIG. 3 is a perspective view illustrating some of the constituents of the dish washing machine. FIG. 4 is a perspective view illustrating a spray unit and diversion unit of the dish washing machine. FIG. 5 is a plan view illustrating a spray unit and diversion unit of the dish washing machine according to one embodiment of the present disclosure.

As shown in FIGS. 1-5, the dish washing machine 100 includes a cabinet 101 forming an external appearance of the dish washing machine 100 and a washing tub 103 arranged in the cabinet 101 to wash dishes. A sump 140 to store wash water is provided at the lower portion of the washing tub 103.

The front of the cabinet 101 is open to allow dishes to be placed in or withdrawn from the washing tub 103, and a door 102 is installed at the front of the cabinet 101 to open and close the washing tub 103. The door 102 is hinged to the front lower portion of the cabinet 101 to open and close the washing tub 103 by rotation.

A pair of dish baskets 104 provided with a accommodation portion having an open upper side to receive dishes is installed at the upper and lower portions of the interior of the washing tub 103 such that the dish baskets 104 are movable forward and backward. The dish baskets 104 are allowed to be placed in or withdrawn from the cabinet 101 through the open front of the cabinet 101 by at least one rack 105 slidably supporting the dish baskets 104. The at least one rack may include an upper rack 105*a* and 105*b*.

The dish baskets 104 are formed by wires arranged in a mesh pattern to allow dishes accommodated in the dish baskets 104 to be exposed to the exterior of the dish baskets 104 so as to be washed.

Spray unit 110 to spray wash water onto the dish baskets 104 are mounted to at least one surface of the washing tub 103. The spray unit 110 may include an upper spray unit 110*a* and a lower spray unit 110*b* to spray water respectively onto an upper dish basket 104*a* and a lower dish basket 104*b*, but embodiments of the present disclosure are not limited thereto.

The spray unit 110 is arranged to spray wash water into the washing tub 103. The spray unit 110 may be provided to at least one surface of the washing tub 103. The spay unit 110 may spray water toward at least one of the lower, upper, and lateral sides of the dish basket 104. The spray unit 110 may be fixed to at least one surface of the washing tub 103.

The spray unit 110 may be positioned at the height of or under the lower end of the dish basket 104 accommodating objects to be washed. The spray unit 110 may spray water in the direction facing away from the location of the spray unit 110. The spray unit 110 may spray water such that at least one first water jet is formed in a direction approximately parallel to the lower end of the dish basket 104.

A diversion unit 120 to divert water sprayed from the spray unit 110 is provided in the washing tub 103. The diversion unit 120 is arranged inside the path of the sprayed wash water to divert the wash water. The direction in which wash water is sprayed from the spray unit 110 will be defined as a first direction, and the direction to which the wash water is diverted by the diversion unit 120 will be defined as a second direction. For example, the diversion unit 120 may be arranged to face the spray unit 110. In the case that the spray unit 110 is arranged to spray water onto the lower end of the dish basket 104, the diversion unit 120 may be positioned at the lower end of the dish basket 104. The diversion unit 120 may be positioned outside the dish basket 104 to linearly move away from or toward the spray unit 110. The first water jet sprayed from the spray unit 110 is directed toward the diversion unit 120 and diverted by the diversion unit 120 to produce a second water jet directed toward the dishes positioned in the dish basket 104. Thereby, the dishes may be washed substantially by the second water jet. For example, the spray unit 110 may be mounted to the rear surface of the washing tub, and the diversion unit 120 may be positioned in the direction parallel to the spray unit 110. The diversion unit 120 may linearly reciprocate to move away from or toward the spray unit 110.

The dish washing machine 100 may further include a drive unit to drive the diversion unit 120 to move within the washing tub 103. The drive unit may include a guide member 131 (or upper and lower guide members 131*a* and 131*b*) coupled to the diversion unit 120 (or upper and lower diversion units 120*a* and 120*b*) and a power generating unit 135 and pulley 134 to drive the diversion unit 120. In addition, the drive unit may include a connection member 133 (or upper and lower connection members 133*a* and 133*b*) to connect the pulley 134 to the diversion unit 120, which will be described later.

The washing tub 103 may be provided with a heater 144 to heat wash water and a heater installation groove 145. The heater installation groove 145 is provided in the bottom of the washing tub 103, and the heater 144 is installed in the heater installation groove 145.

The sump 140 is arranged at the center of the bottom of the washing tub 103 to collect and pump out wash water. The sump 140 includes a wash pump 142 to pump wash water at high pressure and a pump motor 141 to drive the wash pump 142. In addition, a drainage pump 146 to drain wash water is provided at the bottom of the washing tub 103.

The wash pump 142 pumps out wash water toward the upper spray unit 110*a* through a first supply pipe 106 and also pumps out wash water toward the lower spray unit 110*b* through a second supply pipe 108. While the first supply pipe 106 and the second supply pipe 108 are illustrated in FIG. 1 as being separately coupled to the sump 140, embodiments of the present disclosure are not limited thereto. That is, the first supply pipe 106 and the second supply pipe 108 may be branched off from one pipe. The first supply pipe 106 may be connected to a connector 107. The connector 107 may be connected to the spray unit 110*a*. The first supply pipe 106 may also be connected to a spray arm 160 through outlet 106*a*. The first supply pipe may be connected one of pipes 181, 182, 183 connected to a flow control valve 180.

The sump 140 may include a turbidity sensor (not shown) to detect a contamination level of wash water. A controller (not shown) of the dish washing machine 100 may detect the contamination level of wash water using a turbidity sensor (not shown), and control the number of times of performance of washing and rinsing. That is, the controller may increase the number of times of performance of washing and rinsing when the contamination level is high, and decrease the number of times of performance when the contamination level is low.

The diversion unit 120 may be coupled to the drive unit which drives the diversion unit 120 to move within the washing tub 103. The drive unit may include at least one guide member 131 coupled to one side of the diversion unit 120 to guide movement of the diversion The drive unit may include a guide member to guide movement of the diversion unit 120. According to this embodiment, the guide member 131 may be a rail. However, embodiments of the present disclosure are not limited thereto. For example, the guide member may be formed at at least one portion of the dish basket 104 without employing a separate component. It may also be possible that the guide member is formed on at least one portion of the inner surface of the washing tub 103 without employing a separate component. The rollers 132 (or upper and lower rollers 132*a* and 132*b*) of the diversion unit 120 are coupled to the guide member 131 of the drive unit and are movable between the front and rear surfaces of the washing tub 103 along the guide member 131. The guide member 131 of the drive unit is coupled to both sidewalls 103*a* and 103*b* of the washing tub 103. A motor 135 to drive the diversion unit 120 is coupled to the pulley 134. The pulley 134 is connected to the diversion unit 120 through the connection member 133. As the connection member 133, a braided wire or a long and thin string of a carbon material may be used. In addition a belt or a ball screw may be used as the connection member.

In the case that guide members 131 are coupled to both sidewalls 103*a* and 103*b* of the washing tub 103, the motor 135 to drive the diversion unit 120 may be installed at one side of the sidewalls 103*a* and 103*b*, and the pulleys 134 of the guide members 131 may be connected to each other through the shafts outside or inside the washing tub 103.

When the power generating unit 135 operates, the pulleys 134 may move the diversion unit 120 toward the spray unit 110*a* by rotating in one direction and move the diversion unit 120 away from the spray unit 110*a* by rotating in the opposite direction. It may be possible to reversely operate the power generating unit 135. In addition, the diversion unit 120 may be moved away from the spray unit 110*a* by the pressure of wash water sprayed from the spray unit 110*a*. In this case, the spray unit 110*a* moves using the wash water, and therefore it may be possible to perform strong and intensive washing using the diversion unit 120 in washing the dishes. Moreover, in the illustrated embodiment, the drive unit does not need to be directly connected to the flow passage of wash water, and therefore a configuration of the dish washing machine 100 simpler than that in conventional cases may be implemented.

As the power generating unit 135, various motors such as an ultrasonic motor and a linear motor may be used.

In driving the spray unit 110 with the power generating unit 135, the movement speed of the spray unit 110 may be controlled through control of the speed of the power generating unit 135. The speed of the power generating unit 135 may be controlled through a controller (not shown).

Figure 6:
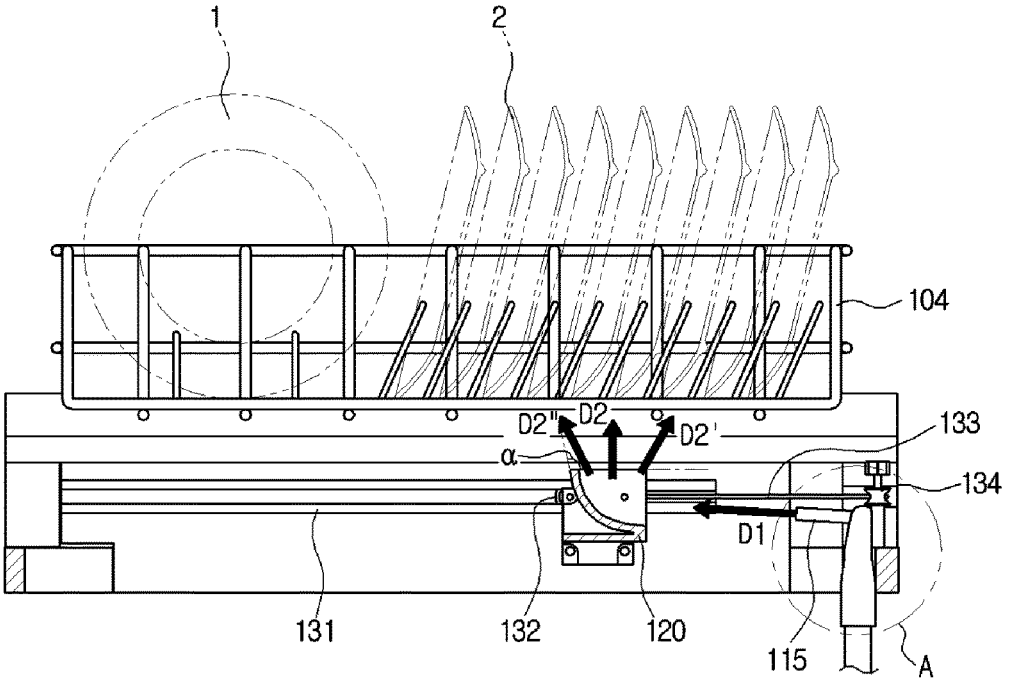
FIG. 6 is an enlarged view illustrating main constituents and directions of spray of wash water according to one embodiment of the present disclosure.
Figure 7:
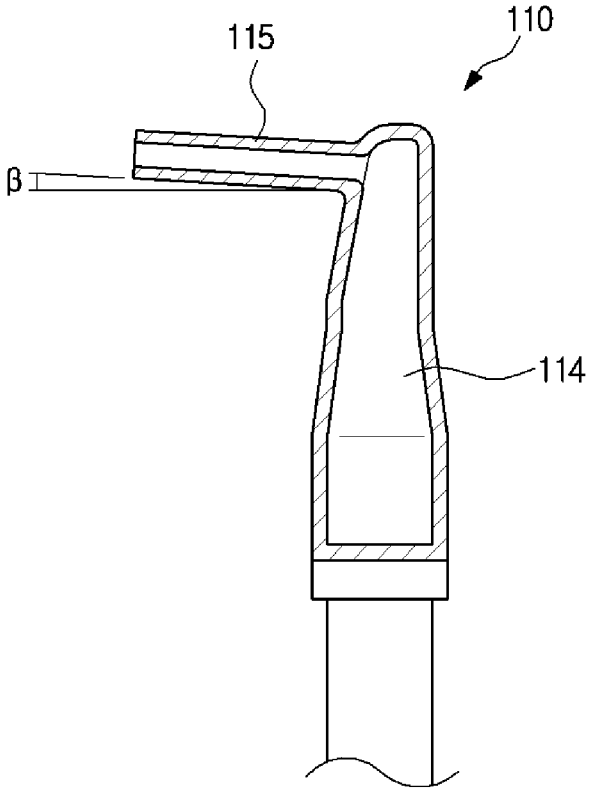
FIG. 7 is an enlarged perspective view illustrating portion A of FIG. 6.

FIG. 6 is an enlarged view illustrating main constituents and directions of spray of wash water according to one embodiment of the present disclosure, and FIG. 7 is an enlarged perspective view illustrating portion A of FIG. 6.

As shown in FIGS. 6 and 7, wash water is sprayed from the spray unit 110 toward the dish basket 104 in a first direction D1. That is, wash water is sprayed in a direction parallel to the dish basket 104. The wash water is diverted to second directions D2, D2' and D2" with respect to the dish basket 104 when contacting the concave portion 125 of the diversion unit 120. The wash water sprayed in the first direction D1 corresponds to the first water jet, and the wash water diverted to the second directions D2, D2' and D2" corresponds to the second water jet. The second water jet formed through diversion of wash water by the diversion unit 120 may be sprayed in the shape of a sheet. Thereby, it may be sprayed onto a wider range of the dishes.

For example, the angle α of flow passage at which wash water sprayed from the spray unit 110 is diverted to the second directions through the diversion unit 120 may be between about 40° and about 140° with the wash water sprayed from the spray unit 110. Since the wash water is diverted to the vertical direction of the dish basket 104, the dishes 1 and 2 may be efficiently washed. Depending upon the angle of the concave portion, the direction in which the wash water is sprayed may vary. That is, the wash water may be sprayed onto the dishes 1 and 2 at various angles. Referring to FIGS. 6 and 7, the second direction in which the wash water is sprayed may include directions D2' and D2" in addition to direction D2. The dishes placed in the dish basket 104 may be arranged to face in various different directions including a traverse direction 1 and longitudinal direction 2. Accordingly, the diversion unit 120 may divert wash water at various angles. Washing of the dishes 1 and 2 is substantially performed by the wash water diverted to the second direction D2, D2', D2" by the diversion unit 120. Since the diversion unit 120 is movable forward and backward by the drive unit, strong and intensive washing of a specific area of the dishes may be performed according to movement of the diversion unit 120.

A head 115 of the spray unit 110 is inclined upward with respect to a line perpendicular to a body 114 of the spray unit 110. The angle β between the line perpendicular to the body 114 and the head 115 may be between about 2° and 5°. This is intended to prevent the wash water sprayed from the spray unit 110 from freely falling downward before it reaches a certain distance.

Table 1 given below shows the heights that the wash water ascends at upward inclination angles of the spray unit 110.

TABLE 1

| Upward Inclination | Ascending height (mm) | |
|---|---|---|
| Angle (°) | 3.1 mAq | 4.0 mAq |
| 1 | 1.0 | 1.2 |
| 1.5 | 2.2 | 2.7 |
| 2 | 3.8 | 4.8 |
| 2.5 | 6.0 | 7.6 |
| 3 | 8.6 | 10.9 |
| 3.5 | 11.7 | 14.8 |
| 4 | 15.3 | 19.3 |
| 4.5 | 19.3 | 24.5 |
| 5 | 23.8 | 30.2 |

As shown in Table 1, when the upward inclination angle β of the head 115 of the spray unit 110 increases, the ascending height (mm) of the sprayed wash water also increases. Thereby, the wash water freely falls downward after reaching a predetermined distance. In the case that the upward inclination angle β is small, wash water falls early. In the case that the upward inclination angle β is excessively large, the wash water freely falls after reaching the highest point. Accordingly, a proper angle needs to be maintained. The head 115 of the spray unit 110 may spray water at an upward angle within 5°. In this case, the diversion unit 120 may evenly wash the dishes in the dish basket 104 through reciprocation, thereby enhancing washing performance. In the case that the upward inclination angle β is between 2° and 5°, the wash water sprayed from the spray unit 110 sufficiently reaches a position of the diversion unit 120 farthest from the spray unit 110, and therefore the sprayed wash water may be prevented from freely falling before reaching the diversion unit 120. In addition, in the case that free fall of the wash water occurs earlier, the size of the diversion unit may need to be increased to divert the wash water. On the other hand, in the case that the head 115 of the spray unit 110 is inclined upward at an angle greater than or equal to a certain angle as in one embodiment, the size of the diversion unit does not need to be increased.

Figure 8:
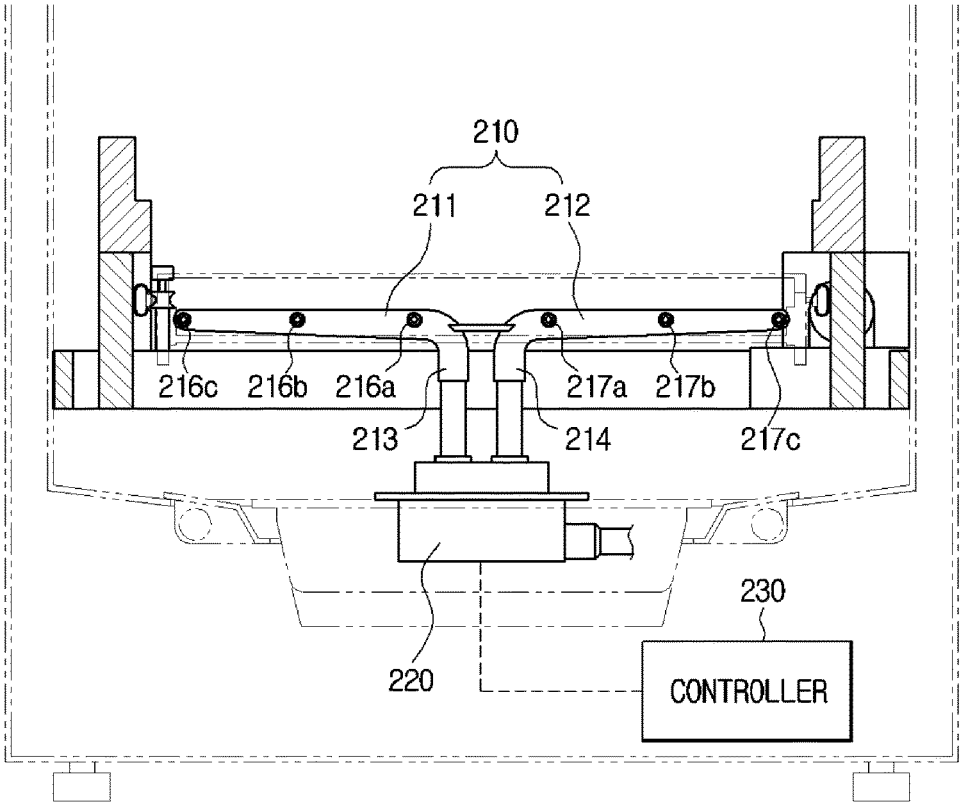
FIG. 8 is a conceptual view schematically illustrating a flow passage in a spray unit according to another embodiment of the present disclosure.
Figure 9:
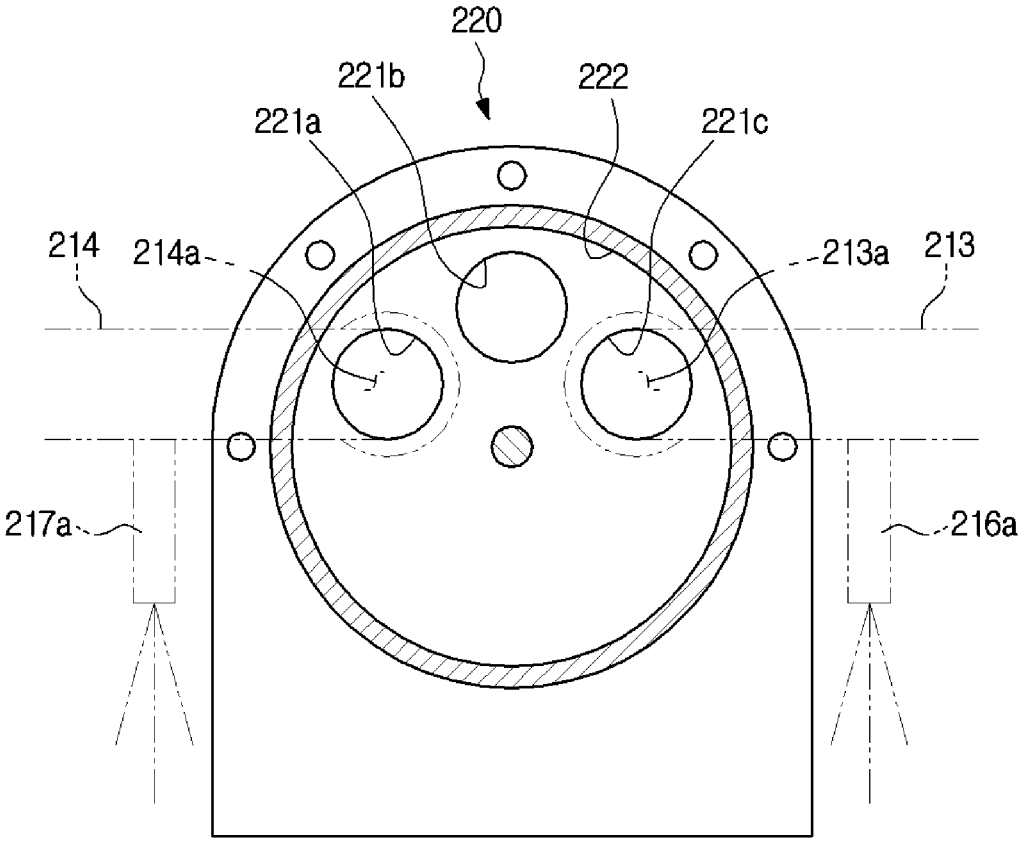
FIG. 9 is a perspective view illustrating a flow passage switching valve with a spray unit fully operating, according to another embodiment of the present disclosure.
Figure 10:
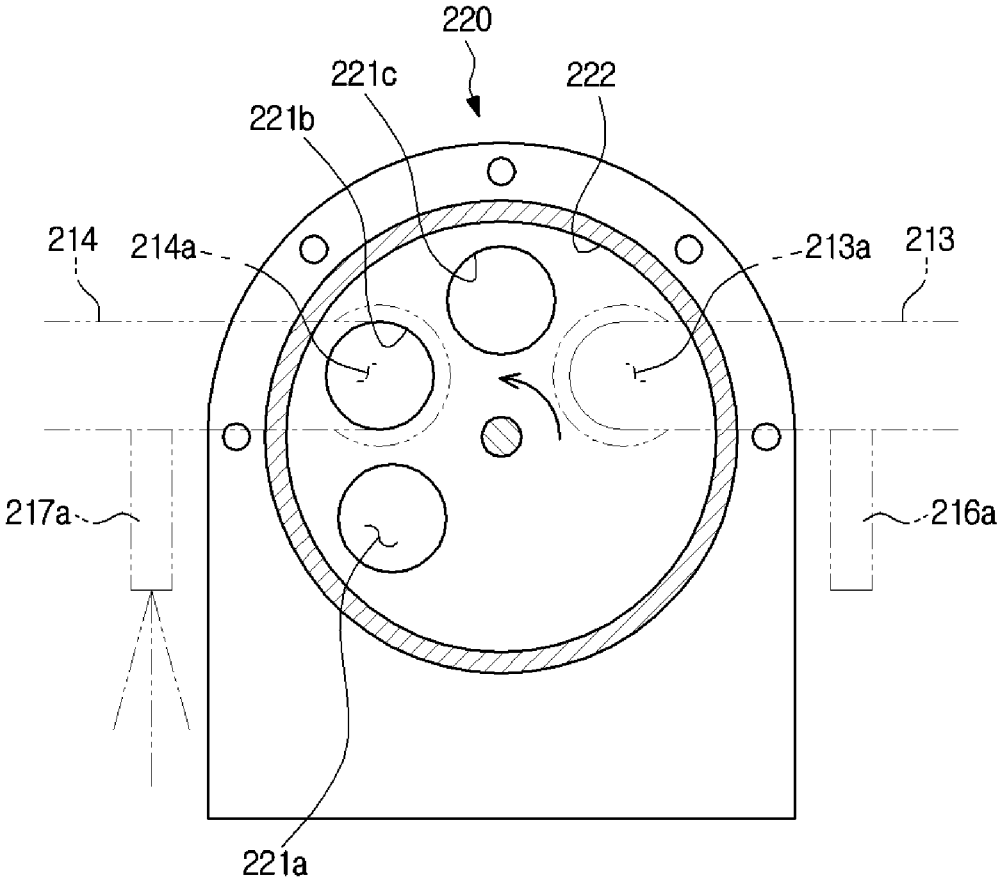
FIG. 10 is a perspective view illustrating a flow passage switching valve with a spray unit partially operating, according to another embodiment of the present disclosure.

FIG. 8 is a conceptual view schematically illustrating a flow passage in a spray unit according to another embodiment of the present disclosure, and FIG. 9 is a perspective view illustrating a flow passage switching valve with a spray unit fully operating, according to another embodiment of the present disclosure. FIG. 10 is a perspective view illustrating a flow passage switching valve with a spray unit partially operating, according to another embodiment of the present disclosure.

As shown in FIG. 8 to FIG. 10, the spray unit 210 may include at least one head group 211, 212. Referring to FIGS. 8 to 10, the head group includes a first head group 211 and a second head group 212. However, embodiments of the present disclosure are not limited thereto.

The first head group 211 may include a first head 216*a*, a second head 216*b*, and a third head 216*c*, and the second head group 212 may include a fourth head 217*a*, a fifth head 217*b*, and a sixth head 217*c*. According to the illustrated embodiment, each head group includes three heads, but embodiments of the present disclosure are not limited thereto. The first head group 211 and the second head group 212 may be allowed to fully operate or partially operate to spray wash water by a flow passage switching valve 220. Operation of the flow passage switching valve 220 may be controlled by a controller 230. Thereby, at least one of the spray pressure, spray time and spray temperature of the wash water may be determined. That is, according to an operation mode of the dish washing machine selected by a user, at least one of spray pressure, spray time, and spray temperature may be controlled for each of the head groups. For example, for a determined head group, at least one of spray pressure, spray time, spray temperature may be set to be high in spraying wash water. Otherwise, at least one of spray pressure, spray time, spray temperature may be set to be low in spraying wash water.

The flow passage switching valve 220 includes a base 222 and a plurality of holes 221*a*, 221*b* and 221*c* provided to the base 222. Whether wash water is sprayed from the first head group 211 or from the second head group 212 is determined depending upon the positions of the holes 221*a*, 221*b* and 221*c*. A first flow passage 213*a* through which wash water passes from line 213 is provided inside the first head group 211, and a second flow passage 214*a* through which wash water passes from line 214 is provided inside the second head group 212. In the case that one of the holes 221*a*, 221*b* and 221*c* of the flow passage switching valve 220 is positioned at the first flow passage 213*a* or the second flow passage 214*a*, the first flow passage 213*a* or the second flow passage 214*a* is opened and the wash water is sprayed from the first head group 211 or the second head group 212.

In the case that the base 222 of the flow passage switching valve 220 rotates and thus the shifted positions of the holes 221*a*, 221*b* and 221*c* do not coincide with the positions of the flow passages 213*a* and 214*a*, the flow passages 213*a* and 214*a* are closed.

Referring to FIG. 10, the holes 221*a*, 221*b* and 221*c* provided to the base 222 are rotated according to rotation of the base 222 and thus the positions of the first flow passage 213*a* do not coincide with the positions of the holes. Accordingly, the first flow passage 213*a* is closed. Thereby, wash water is not sprayed from the first head group 211, and the wash water is sprayed only from the second head group 212 connected to the opened second flow passage 214*a*. As described above, it may be possible to adjust operation of the spray unit 210 through operation of the flow passage switching valve 220 such that only a portion of the spray unit 210 operates.

In the case that the dishes are located in a predetermined area, wash water may be sprayed onto a desired area according to operation of the flow passage switching valve 220. Therefore, it may be possible to save wash water and control the spray pressure, spray time, and temperature of the wash water for the desired area.

Figure 11:
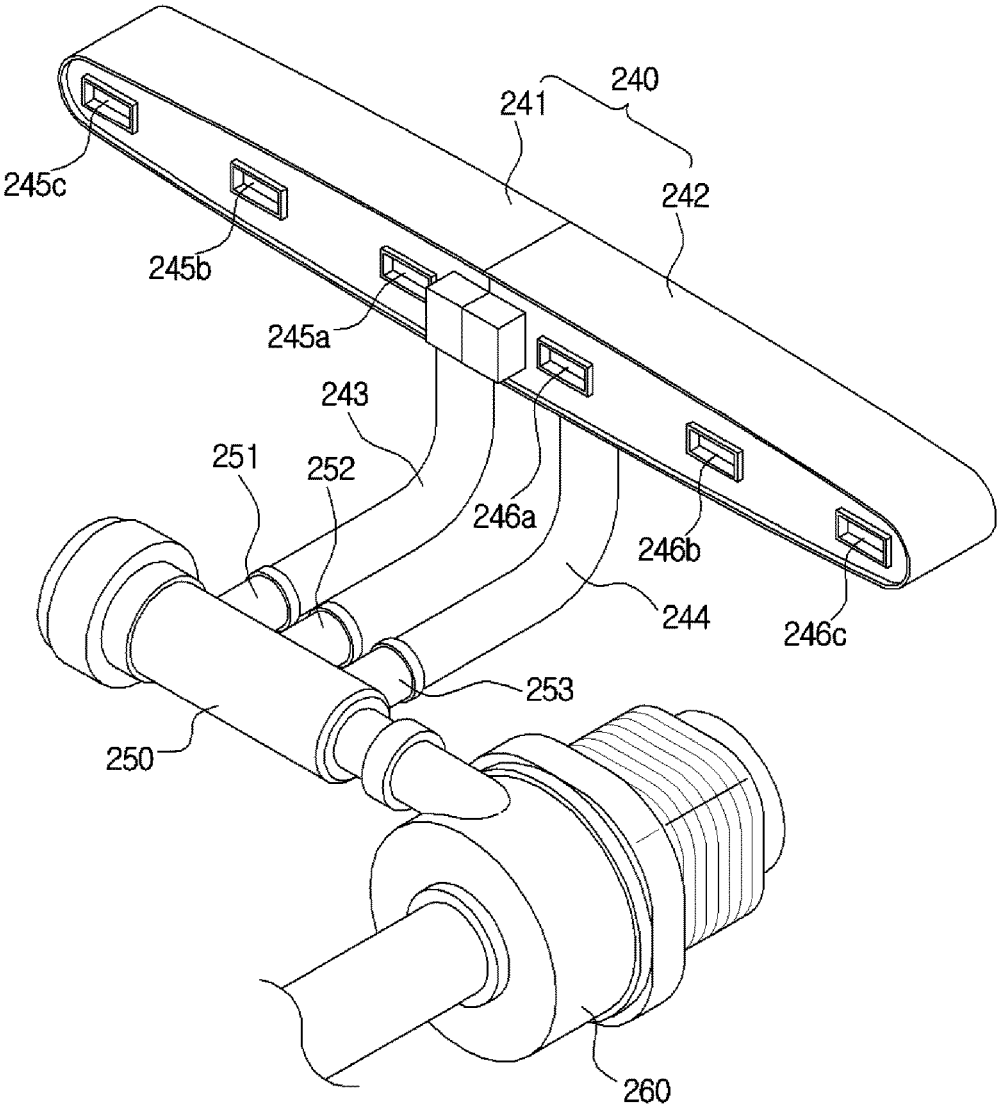
FIG. 11 is a perspective view illustrating a spray unit according to another embodiment of the present disclosure.
Figure 12:
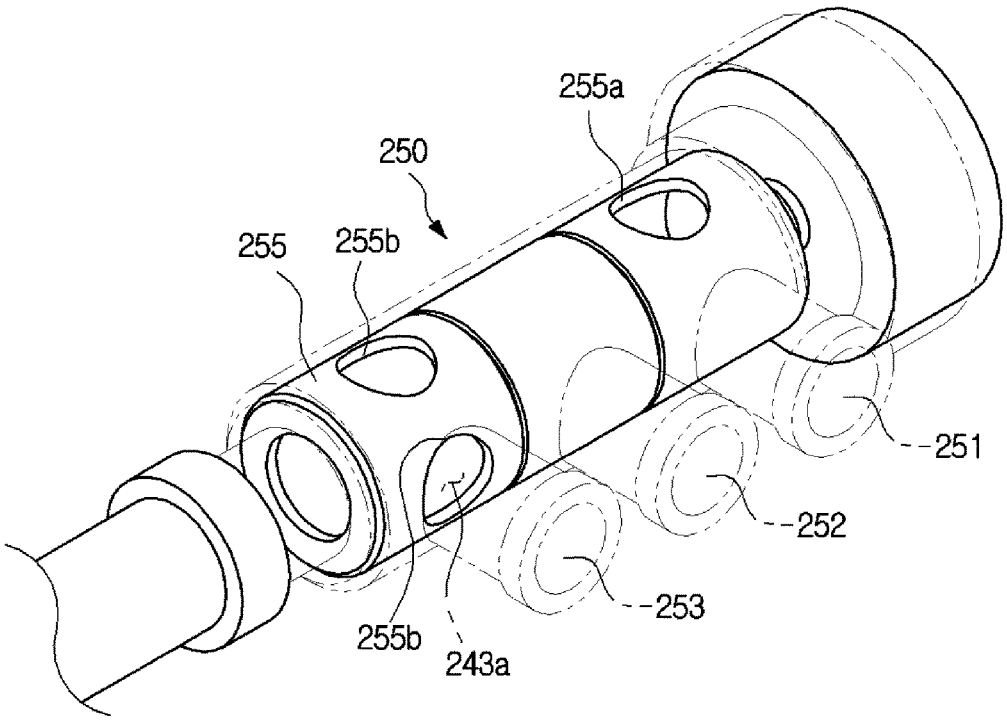
FIG. 12 is a perspective view illustrating the flow passage switching valve with the spray unit of FIG. 11 partially operating.
Figure 13:
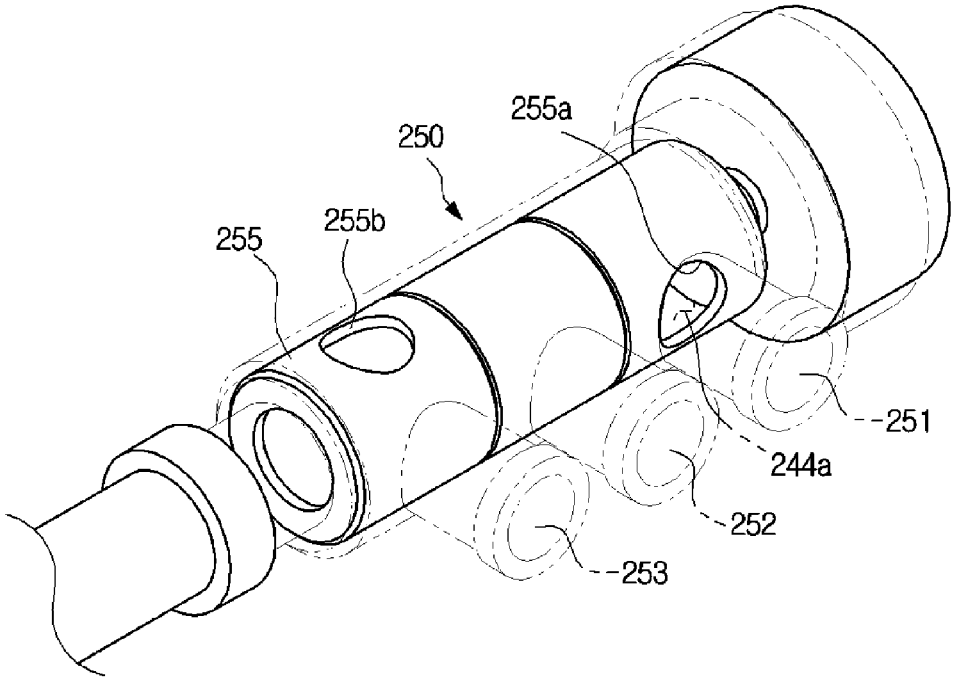
FIG. 13 is a perspective view illustrating the flow passage switching valve with the spray unit of FIG. 11 partially operating.

FIG. 11 is a perspective view illustrating a spray unit according to another embodiment of the present disclosure, and FIG. 12 is a perspective view illustrating the flow passage switching valve with the spray unit of FIG. 11 partially operating. FIG. 13 is a perspective view illustrating the flow passage switching valve with the spray unit of FIG. 11 partially operating.

The embodiment illustrated in FIGS. 11 to 13 differs from the embodiment illustrated in FIGS. 8 to 10 in the position of the flow passage switching valve.

The two embodiments are in common in that wash water sprayed from a head group 240 is adjusted by a flow passage switching valve 250. Accordingly, in the case that the position of a plurality of holes 255*a* and 255*b* is shifted by rotation of a base 255 and thus does not coincide with the positions of flow passages 243*a* and 243*b*, the flow passages 243*a* and 243*b* are closed. In the case that the positions of the holes 255*a* and 255*b* coincides with those of the flow passages 243*a* and 243*b*, the flow passage may be opened and thus wash water may be sprayed through the head group 240 by pump 260.

According to one embodiment, the base 255 may be formed in a cylindrical shape. At least one hole 255*a*, 255*b* which may communicate with the flow passages 243*a* and 243*b* may be provided to the curved surface of the base 255. A first hole 255*a* may communicate with a first head group 241 to control the wash water sprayed from the first head group 241. A second hole 255*b* may communicate with a second head group 242 to control the wash water sprayed from the second head group 242. The first hole 255*a* communicates with first communication pipes 251 and 243, forming a first flow passage 243*a* connected to the first head group 241. The second hole 255*b* communicates with second communication pipes 253 and 244, forming a second flow passage 243*b* connected to the second head group 242. A third communication pipe 252 arranged between the first communication pipe 251 and the second communication pipe 253 may be connected to the spray unit positioned at the upper end thereof.

By varying the position of the flow passage switching valve 250 as above, the wash water sprayed from each head group may be controlled.

Spray of wash water from the first head groups 211 and 241 and the second head groups 212 and 242 may be controlled using the flow passage switching valves 220 and 250. The first head groups 211 and 241 and the second head groups 212 and 242 may be arranged in various manners. For example, the fourth head 217*a*, 246*a*, fifth head 217*b*, 246*b* and sixth head 217*c*, 246*c* of the second head group 212, 242 may be positioned between the first head 216*a*, 245*a*, second head 216*b*, 245*b*, and third head 216*c*, 245*c* of the first head group 211, 241. Thereby, the heads of the first head group are arranged at odd-numbered positions, and the heads of the second head group are arranged at even-numbered positions. When the head groups are respectively controlled using the flow passage switching valve, the heads at odd-numbered positions and the heads at even-numbered positions may be separately controlled to spray wash water.

Figure 14:
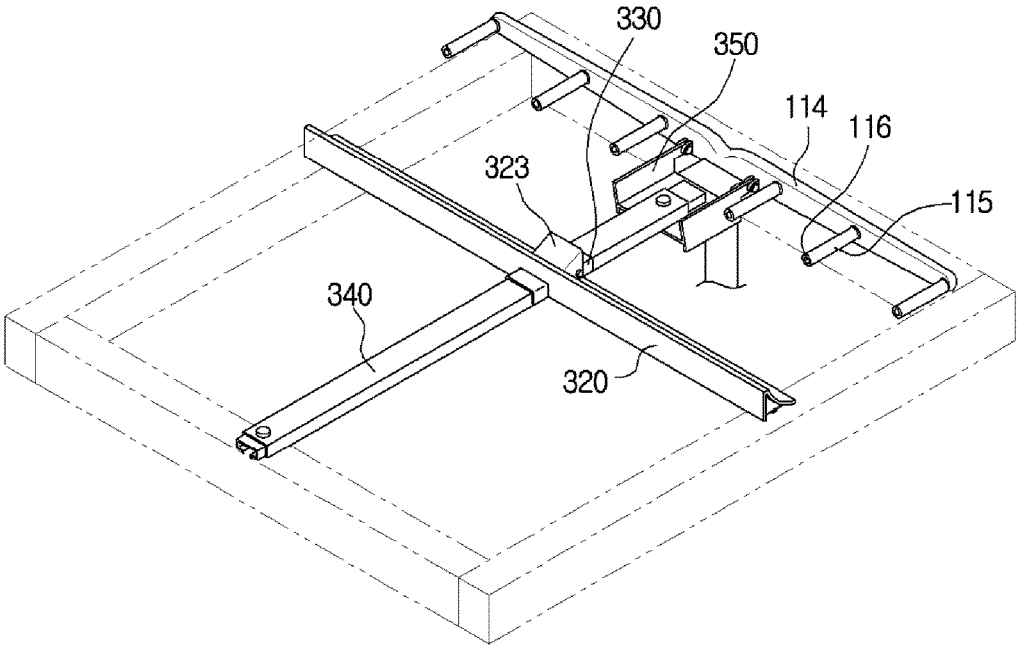
FIG. 14 is a plan view illustrating a spray unit and a diversion unit according to another embodiment of the present disclosure.
Figure 15:
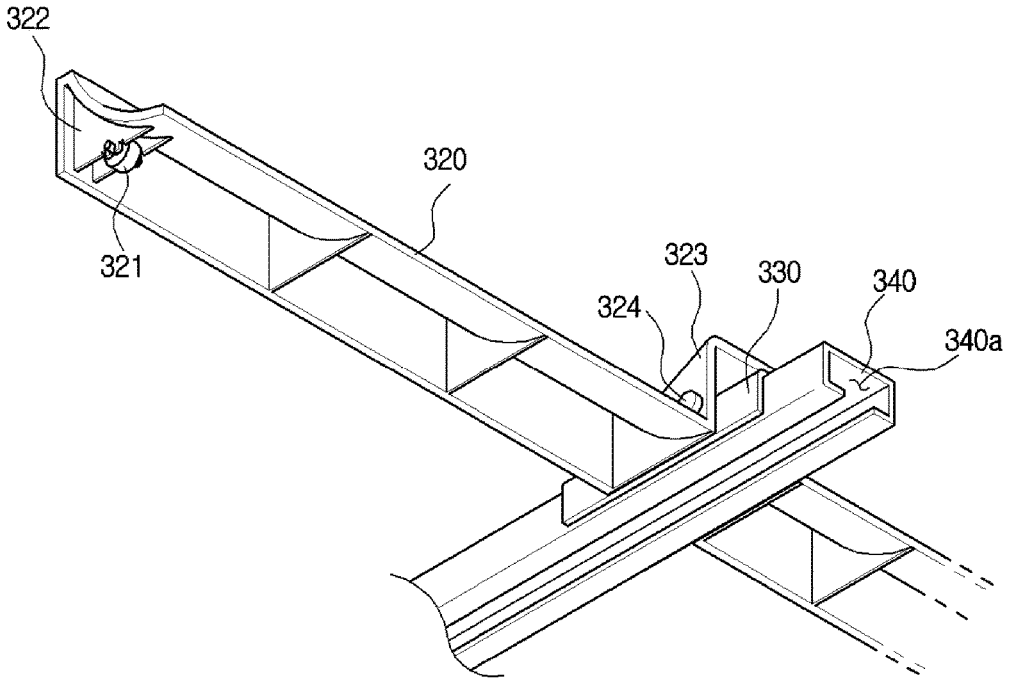
FIG. 15 is a view illustrating a diversion unit according to another embodiment of the present disclosure.
Figure 16:
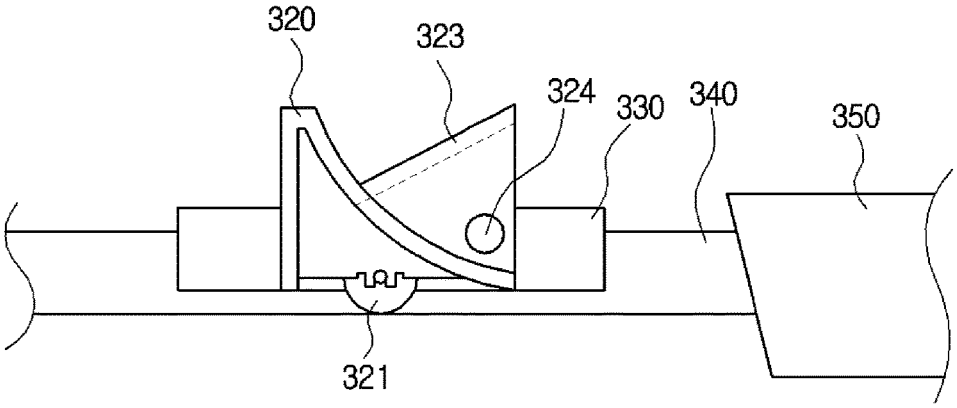
FIG. 16 is a view illustrating the position of a diversion unit according to another embodiment of the present disclosure prior to contact with a catch member.
Figure 17:
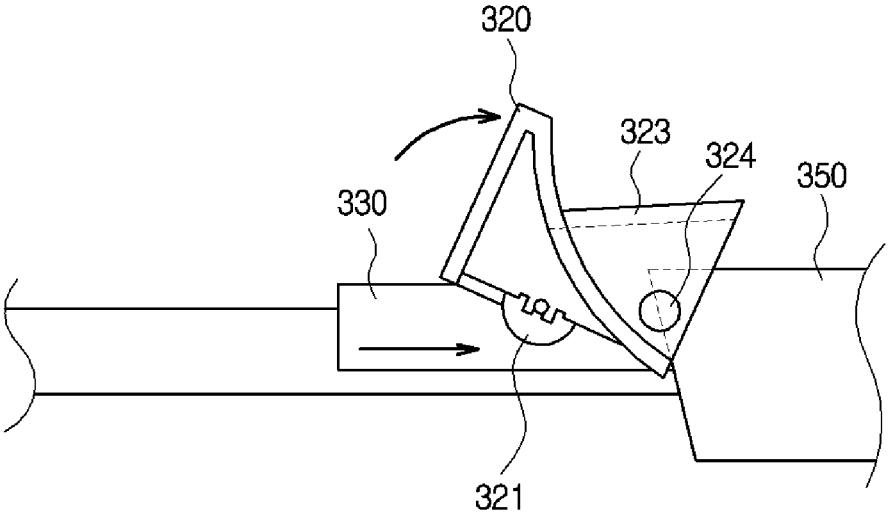
FIG. 17 is a view illustrating the position of a diversion unit according to another embodiment of the present disclosure after contact with a catch member.
Figure 18:
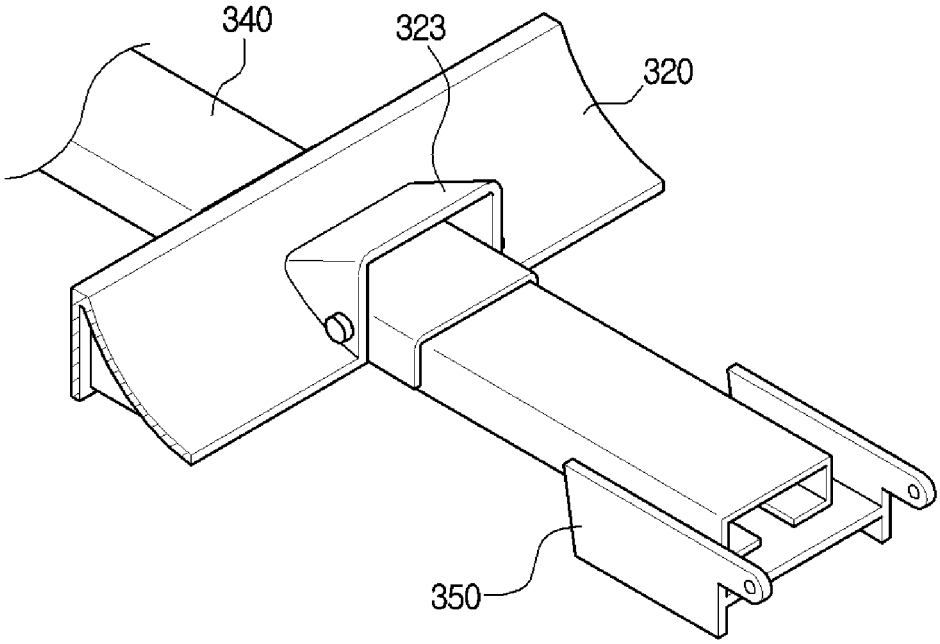
FIG. 18 is a perspective view illustrating the position of a diversion unit according to another embodiment of the present disclosure prior to contact with a catch member.
Figure 19:
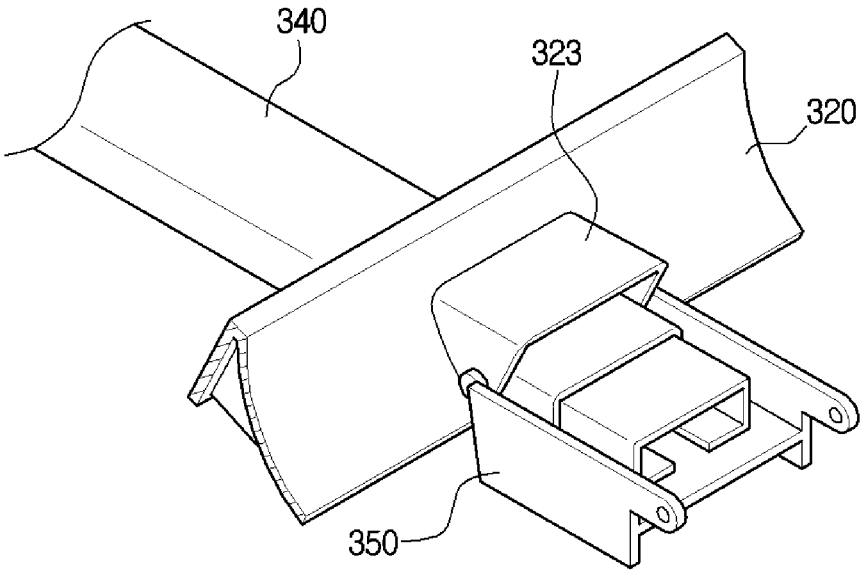
FIG. 19 is a perspective view illustrating the position of a diversion unit according to another embodiment of the present disclosure after contact with a catch member.

FIG. 14 is a plan view illustrating a spray unit and a diversion unit according to another embodiment of the present disclosure, and FIG. 15 is a view illustrating a diversion unit according to another embodiment of the present disclosure. FIG. 16 is a view illustrating the position of a diversion unit according to another embodiment of the present disclosure prior to contact with a catch member, and FIG. 17 is a view illustrating the position of a diversion unit according to another embodiment of the present disclosure after contact with a catch member. FIGS. 18 and 19 are perspective views illustrating the position of a diversion unit according to another embodiment of the present disclosure prior to and after contact with a catch member.

As shown in FIGS. 14 to 19, a diversion unit 320 may be coupled to one guide member 340. The guide member 340 may be positioned inside the washing tub and coupled to the center portion of the diversion unit 320 to support the diversion unit 320. A catch member 350 to change the angle of the diversion unit 320 may be positioned at one side of the washing tub, which will be described later.

A holder 330 may be positioned at the guide member 340 to guide coupling between the diversion unit 320 and the guide member 340. The holder 330 is coupled to the guide member 340, and the diversion unit 320 is coupled to the holder 330. One side of the diversion unit 320 may be provided with a coupling portion 323 protruding upward to be coupled to the holder 330. The coupling portion 323 may be hinged to the holder 330 by a coupling member 324. Balance members 321 to prevent rocking of the diversion unit 320 may be coupled to both sides of the diversion unit 320. As the balance members 321, rollers may be used to maintain the both sides of the diversion unit 320 at the same level and allow smooth movement of the diversion unit. The balance member 321 may be coupled to the lower surface of the diversion unit 320. To this end, ribs 322 may be provided to both side surfaces of the diversion unit 320 to be coupled to the balance member 321. A relieving member (not shown) to relieve shock occurring during movement of the diversion unit 320 may be separately coupled to the outer surface of the balance member 321. As the relieving member (not shown), rubber may be used.

The diversion unit 320 is pivotably hinged to rotate an angle greater than or equal to a certain angle with respect to the holder 330. Thereby, the diversion unit 320 moves within the washing tub under the conditions shown in FIG. 11 until it contacts the catch member 350. As shown in FIG. 12, after the diversion unit 320 contacts the catch member 350, the diversion unit 320 rotates an angle greater than or equal to a certain angle with respect to the holder 330 coupled to the guide member 340. Thereby, angle of the diversion unit 320 changes, and accordingly the spray angle of the wash water whose flow passage is switched by the diversion unit 320 also changes. Since the diversion unit 320 may be rotated by various angles, dead zones which spray of wash water does not reach may be eliminated.

In addition, as shown in FIG. 15, an opening 340*a* may be provided on the lower surface of the guide member 340. Thereby, contaminants produced during washing of the dishes may be drained through the opening 340*a* and prevented from being accumulated at the guide member 340.

Figure 20:
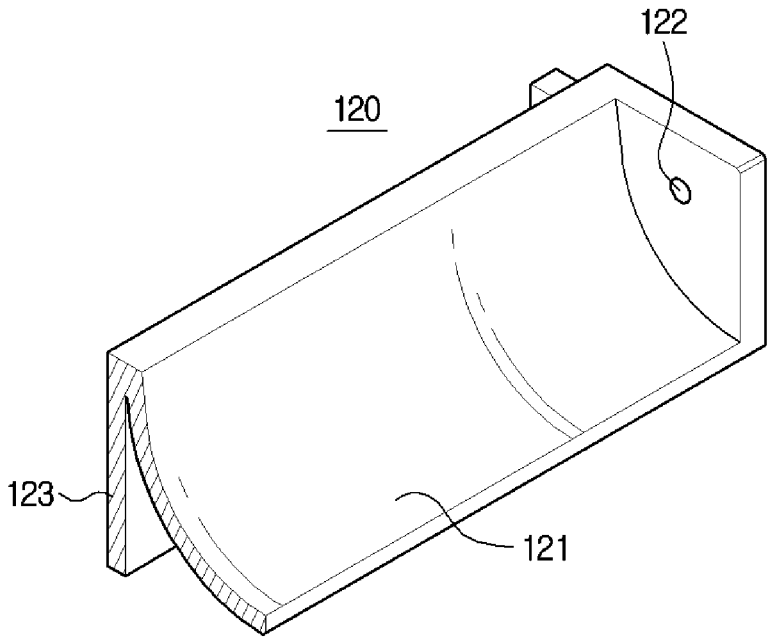
FIG. 20 is an enlarged perspective view illustrating a diversion unit according to one embodiment of the present disclosure.

FIG. 20 is an enlarged perspective view illustrating a diversion unit according to one embodiment of the present disclosure.

Referring to FIG. 20, the diversion unit 120 may include a concave portion 121 to divert wash water. While the concave portion 121 is illustrated in FIG. 20 as being formed in the shape of a curved surface, embodiments of the present disclosure are not limited thereto.

A rear wall 123 is provided on the rear surface of the concave portion 121, and sidewalls 122 are provide at both sides of the concave portion 121. Rollers may be coupled to the sidewalls 122. The concave portion 121 of the diversion unit 120 guides diversion of the wash water sprayed from the spray unit.

The wash water is sprayed through the spray hole of the spray unit. However, since the wash water diverted to the second direction D2 along the concave portion 121 of the diversion unit 120 is sprayed onto the dishes, the wash water sprayed onto the dishes covers a wider area than the wash water sprayed through the spray hole. Accordingly, the possibility of leaving portions of the dishes unwashed may be reduced.

FIGS. 21 to 28 are enlarged perspective views illustrating a diversion unit according to various embodiments of the present disclosure.

Figure 21:
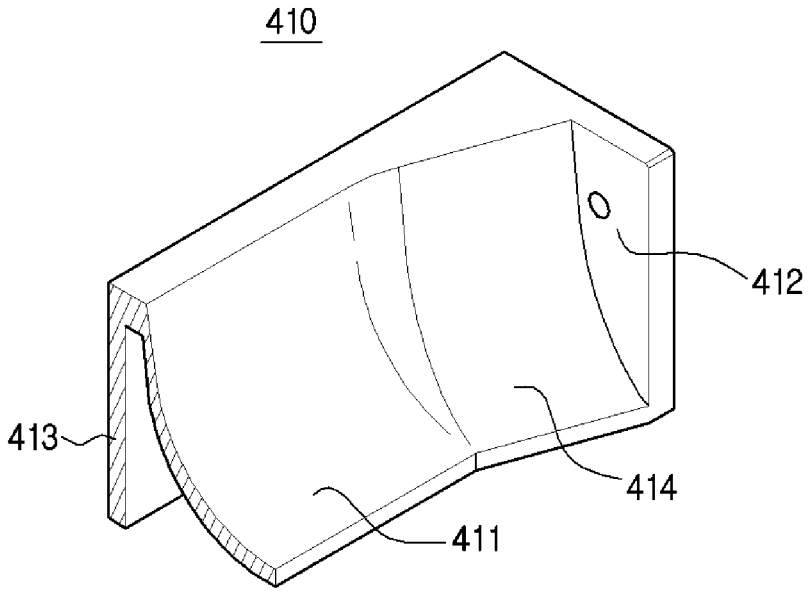
FIG. 21 is an enlarged perspective view illustrating a diversion unit according to another embodiment of the present disclosure.

Referring to FIG. 21, a diversion unit 410 may include rear wall 413 provided on the rear surface of concave portion 411, sidewalls 412 provided at both sides of the concave portion 411, and the concave portion 411 may include at least one bent portion 414 bent along the longitudinal direction of the diversion unit 410 to divert the sprayed wash water in various directions. A bent portion 414 may be bent at various angles in the direction toward the concave portion 411 or the direction away from the concave portion 411. Thereby, the direction of the sprayed wash water may be adjusted. In addition, a plurality of bent portions 414 may alternatively be provided to spray the wash water in various directions according to respective portions.

Figure 22:
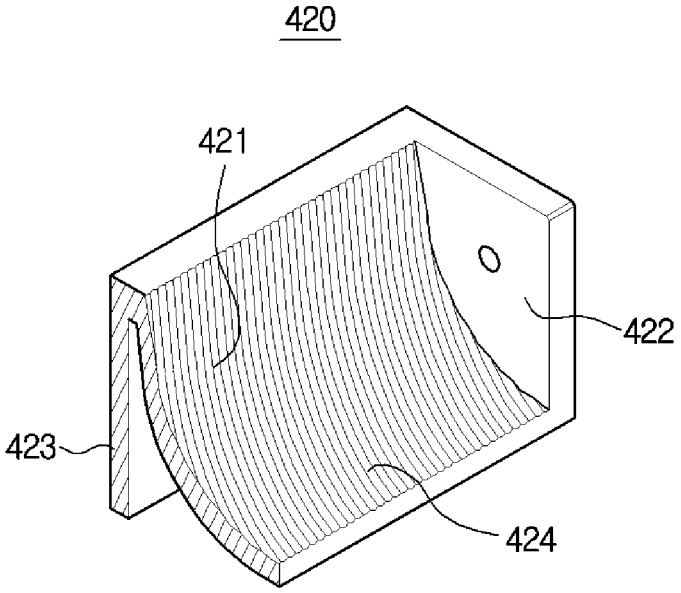
FIG. 22 is an enlarged perspective view illustrating a diversion unit according to another embodiment of the present disclosure.

Referring to FIG. 22, a diversion unit 420 may include rear wall 423 provided on the rear surface of concave portion 421, sidewalls 422 provided at both sides of the concave portion 421, and the concave portion 421 may be provided with a plurality of grooves 424 at the concave portion 421 to guide diversion of wash water. When the wash water contacts the grooves 424, it is diverted by being pushed upward along the grooves 424 of the concave portion 421 due to water pressure.

Figure 23:
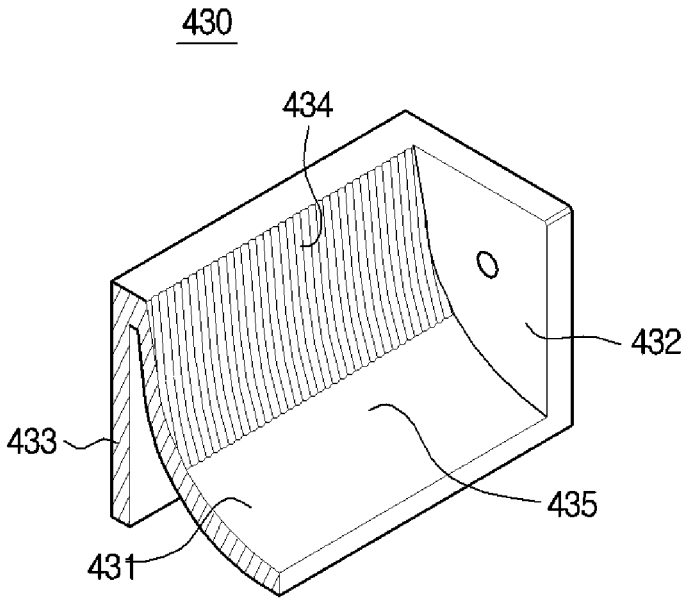
FIG. 23 is an enlarged perspective view illustrating a diversion unit according to another embodiment of the present disclosure.

Referring to FIG. 23, a diversion unit 430 may include rear wall 433 provided on the rear surface of concave portion 431, sidewalls 432 provided at both sides of the concave portion 431, and the concave portion 431 is divided into two regions. That is, the concave portion 431 may include a first region 435 having no groove and a second region 434 having grooves formed therein. Thereby, the wash water sprayed from the spray unit is guided along the grooves in the second region 434 and diverted.

Figure 24:
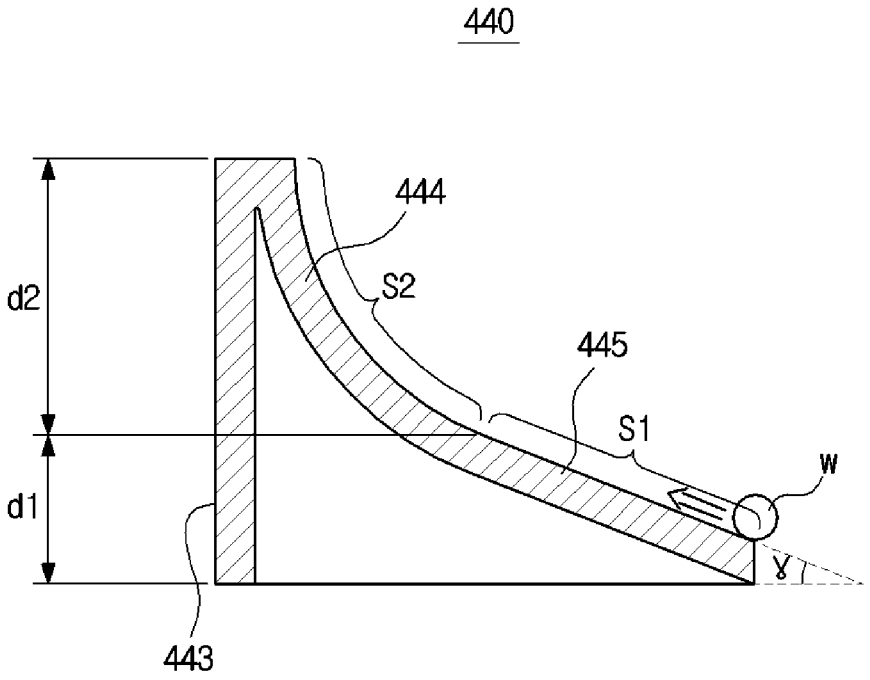
FIG. 24 is a cross-sectional view illustrating a diversion unit according to another embodiment of the present disclosure.

Referring to FIG. 24, a diversion unit 440 may include rear wall 443 and concave portions 444 and 445 may include a curved surface 444 and a flat surface 445. The distance by which the wash water sprayed from the spray unit reaches the diversion unit 440 may vary depending upon the revolutions per minute (RPM) of the pump. That is, in the case that water pressure is low, the wash water is not sprayed to a far distance, and thus it moves a relatively short distance. In the case that water pressure is high, the wash water is sprayed to a far distance, and thus it moves a relatively long distance. Even when the diversion unit 440 is located at the farthest position from the spray unit, the hitting section of the diversion unit 440 that the sprayed wash water reaches is important in diverting the wash water with the diversion unit 440. In the case that the vertical cross section of the diversion unit 440 includes a straight section S1 provided with a flat surface 445 and a curved section S2 provided with a curved surface 444 as shown in FIG. 24, the point that the wash water hits may be formed in the straight section S1 provided with the flat surface 445.

Considering the wash water pressure, the sprayed wash water may reach the diversion unit 440 with minimum loss of flow rate only when the height of straight section S1 of the diversion unit 440 is greater than or equal to a certain height d1. The vertical height d1 of the straight section S1 may be greater than or equal to 15 mm from the bottom surface of the diversion unit 440. In addition, to smoothly divert the wash water reaching the straight section S1 to form a second water jet, the curved section S2 may be formed at the upper side of the straight section S1. The vertical height d2 of the curved section from the bottom surface of the diversion unit 440 may be greater than the vertical height d1 of the straight section S2. That is, a relationship of d1>d2 may be formed.

As illustrated in FIGS. 16 to 19, the diversion unit 440 is rotated by the catch member of the spray unit. Considering the rotating section of the diversion unit 440, the incident angle $\alpha$ of the wash water on the diversion unit 440 may be within 35°.

The concave portion may be formed in various different shapes. The shapes are not limited to the shape shown in FIG. 23. For example, the concave portion may have a combination of a second-order curve such as a circle, an ellipse, a parabola, a hyperbola, and an involute, and a first-order curve.

Figure 25:
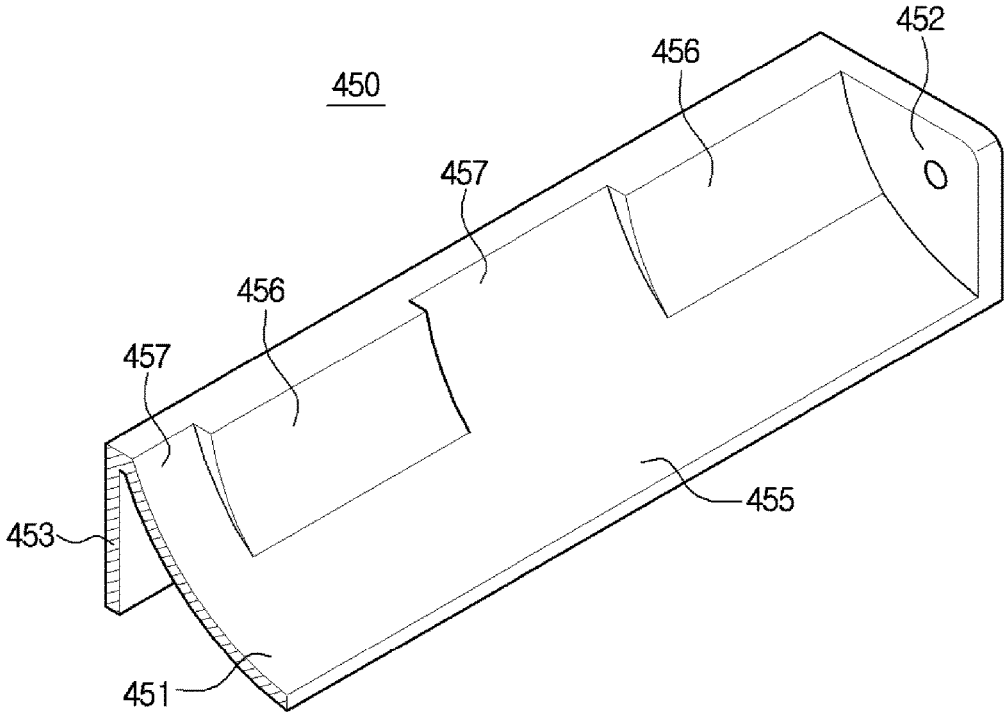
FIG. 25 is a view illustrating a diversion unit according to another embodiment of the present disclosure.
Figure 26:
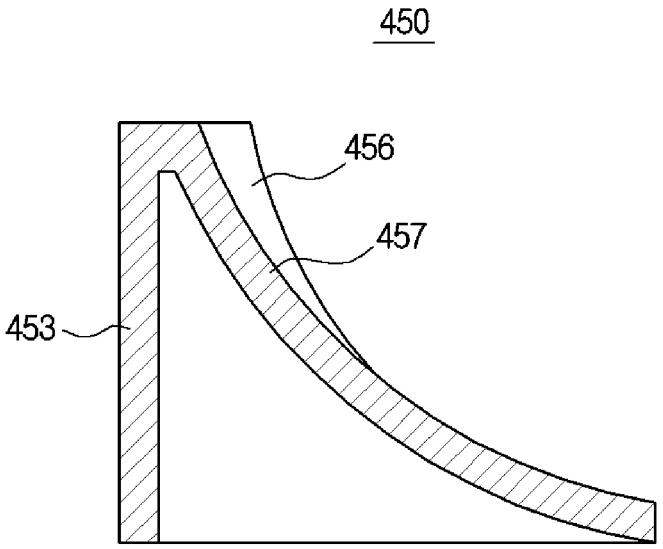
FIG. 26 is a cross-sectional view illustrating a diversion unit according to another embodiment of the present disclosure.
Figure 27:
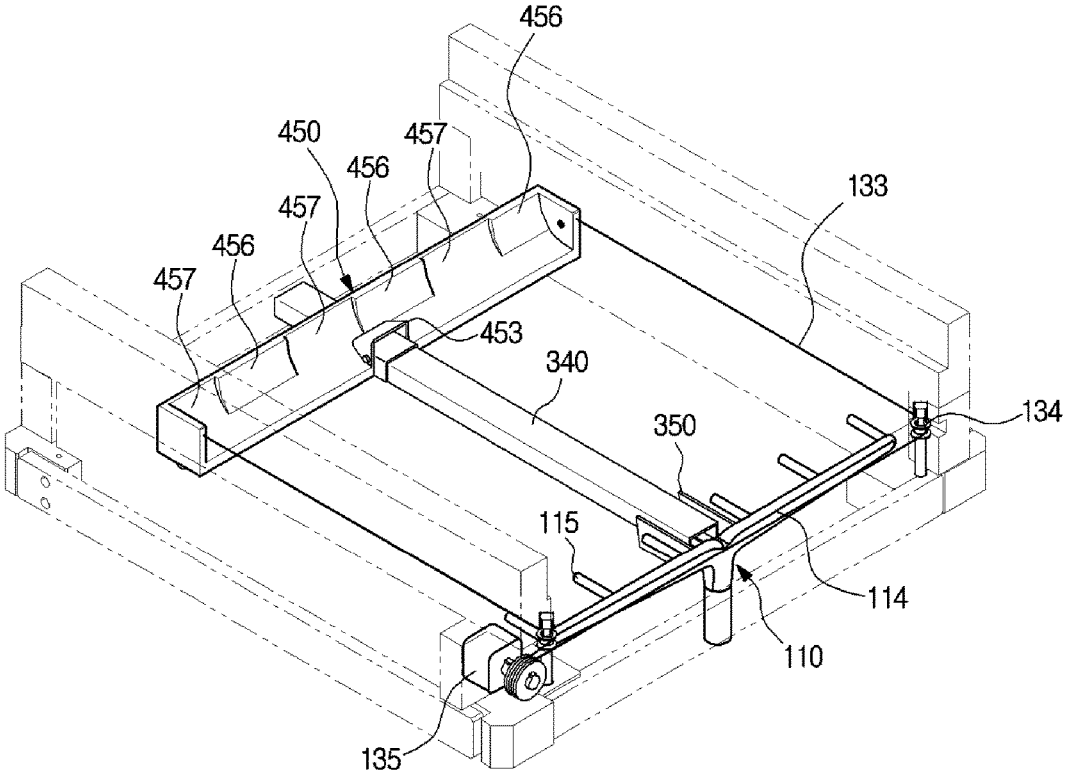
FIG. 27 is a view illustrating a spray unit and diversion unit of a dish washing machine according to another embodiment of the present disclosure.

Referring to FIGS. 25 to 27, a diversion unit 450 may include rear wall 453 provided on the rear surface of concave portion 451, sidewalls 452 provided at both sides of the concave portion 451, and the concave portion 451 includes an introduction portion 455 into which wash water is introduced and discharge portions 456 and 457 from which the wash water is sprayed. The discharge portions 456 and 457 include a first step portion 456 and a second step portion 457. The first step portion 456 and the second step portion 457 may be formed in a stepped manner. That is, when the diversion unit 450 is cross-sectionally cut in a certain direction, the shape of the cross section of the first step portion 456 and the second step portion 457 may not be uniform. A plurality of first step portions 456 and a plurality of second step portions 457 may be provided. The step distance between the first step portion 456 and the second step portion 457 may be at least 2 mm. The flow passage of the wash water formed by the introduction portion 455 and the first step portion 456 will be defined as a first region, and the flow passage of the wash water formed by the introduction portion 455 of the second step portion 457 will be defined as a second region. The first region and the second region may be alternately positioned to form the diversion unit 450.

Referring to FIGS. 25 to 27, both the introduction portion 455 and the discharge portions 456 and 457 have curved surfaces. However, embodiments of the present disclosure are not limited thereto. The introduction portion 455 may be provided with a flat surface such that the movement path of the wash water includes a linear section. In this case, the slope of the straight section of the first region may be equal to the slope of the straight section of the second region, and the curved sections of the regions may have different lengths. Thereby, the sheet shapes of the regions formed by the curved section may be prevented from causing interference between water jets. In addition, by setting the slope of the straight section of the first region to be different from the slope of the straight section of the second region, the height at which the first water jet introduced into the diversion unit 450 is diverted to the second water jet may be changed.

This is intended to prevent the water portions sprayed from the heads of the spray unit from being interfered with each other to weaken spray force of the wash water after being diverted by the diversion unit 450. The flow passage of the wash water is diverted along the diversion unit 450. Accordingly, forming a certain portion of the diversion unit 450 in a stepped manner may produce difference in angle between neighboring portions of wash water, thereby preventing interference between the portions of wash water.

Referring to FIG. 27, in the case that six heads 115 of the spray unit 110 are provided, the region of the diversion unit 450 that the wash water reaches may include six regions corresponding to the heads 115. The concave portion 451 may be divided into regions corresponding to the heads 115 of the spray unit 110 in one diversion unit 450, and the regions corresponding to the heads 115 include the first region and second region which are alternately positioned, as described above. In this case, to form a sheet-shaped water jet with minimum loss of flow rate of the wash water, the six heads 115 may be kept spaced 80 mm from each other. The first region and the second region may be formed to have different curvatures such that the wash water is sprayed at different angles. Referring to FIG. 27, the curvatures of the discharge portion 456 of the first region and the discharge portion 457 of the second region are different from each other. However, embodiments of the present disclosure are not limited thereto. The introduction portion 455 may have a different curvature.

Figure 28:
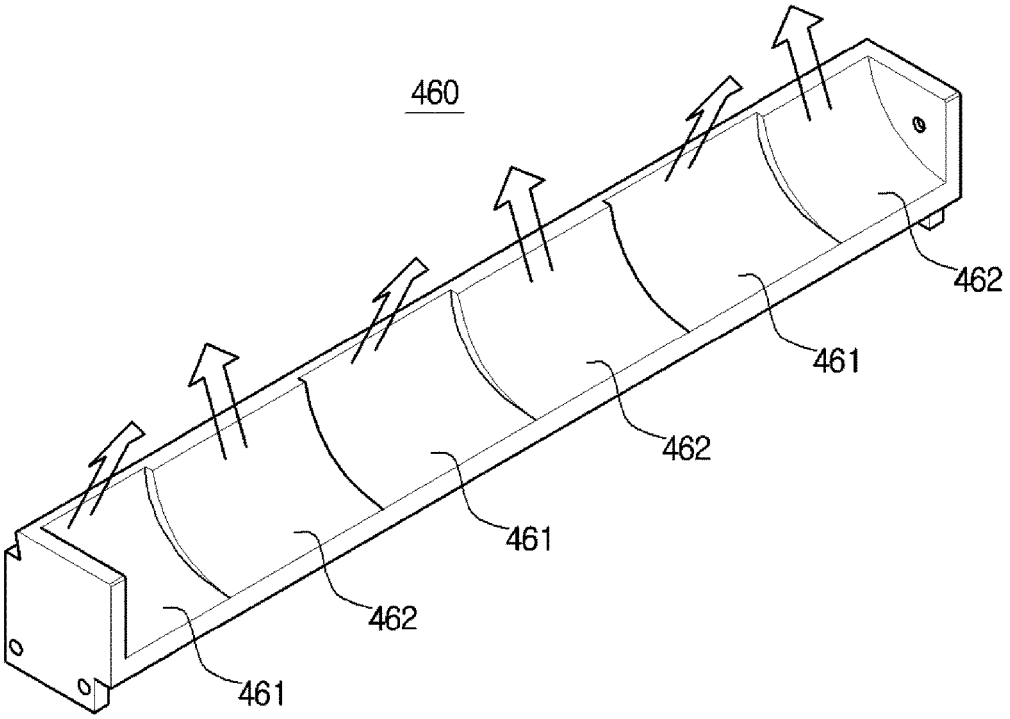
FIG. 28 is a view illustrating a diversion unit according to another embodiment of the present disclosure.

FIG. 28 is a view illustrating a diversion unit according to another embodiment of the present disclosure.

As shown in FIG. 28, a diversion unit 460 is formed such that each of the heads spraying wash water have a different spray angle for the second water jet.

The diversion unit 460 may include a plurality of concave portions 461 and 462. The first concave portion 461 and the second concave portion 462 may be formed in a stepped manner. The first concave portions 461 and the second concave portions 462 may be alternately disposed to construct one diversion unit 460. According to one embodiment of the present disclosure, the concave portions 461 and 462 including three first concave portions 461 and three second concave portions 462 may be provided to respectively correspond to six heads 115.

Since the first concave portions 461 and the second concave portions 462 are formed in a stepped manner, the second water jets produced by diverting the wash water to the second direction may have different heights. Thereby, the second water jet discharged from the first concave portion 461 may have a different discharge angle over the second water jet discharged from the second concave portion 462. For example, the discharge angle may be formed between 40° and 140° such that the first concave portion 461 has a different discharge angle over the second concave portion 462.

In addition, the slope of the straight section of the first region may be set to be different from that of the straight section of the second region such that the height at which the second water jet is formed by diverting the first water jet introduced into the diversion unit 450.

Figure 29:
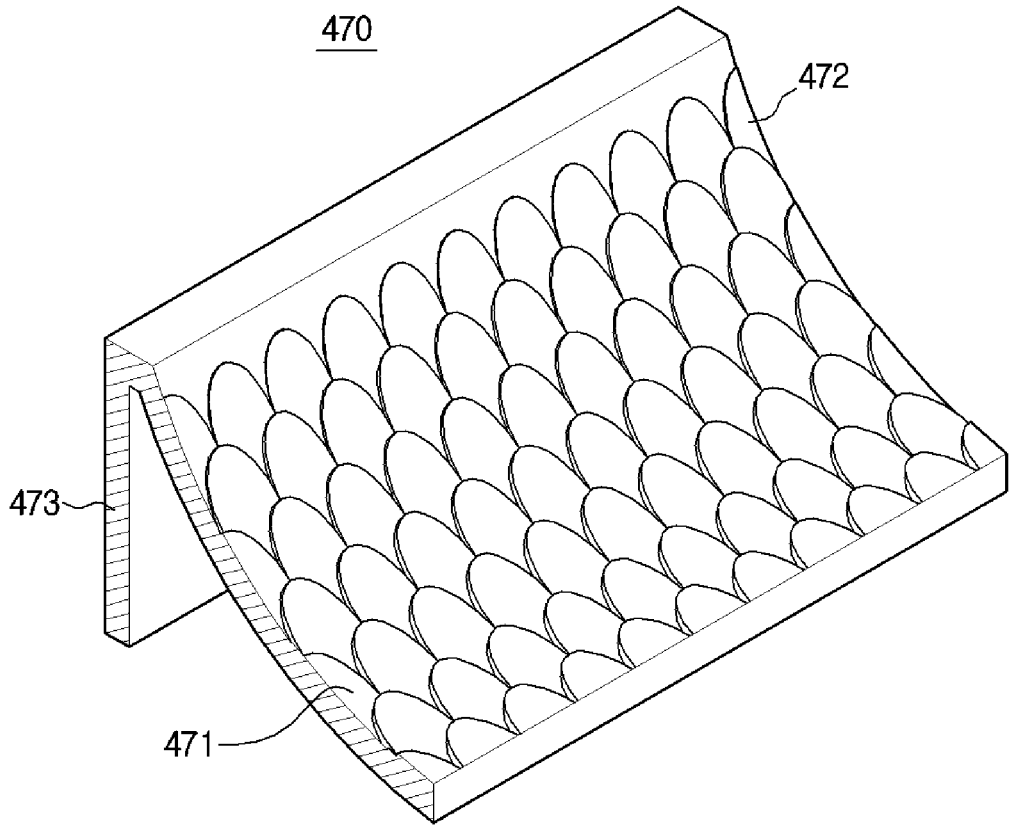
FIG. 29 is a cross-sectional view illustrating a diversion unit according to another embodiment of the present disclosure.
Figure 30:
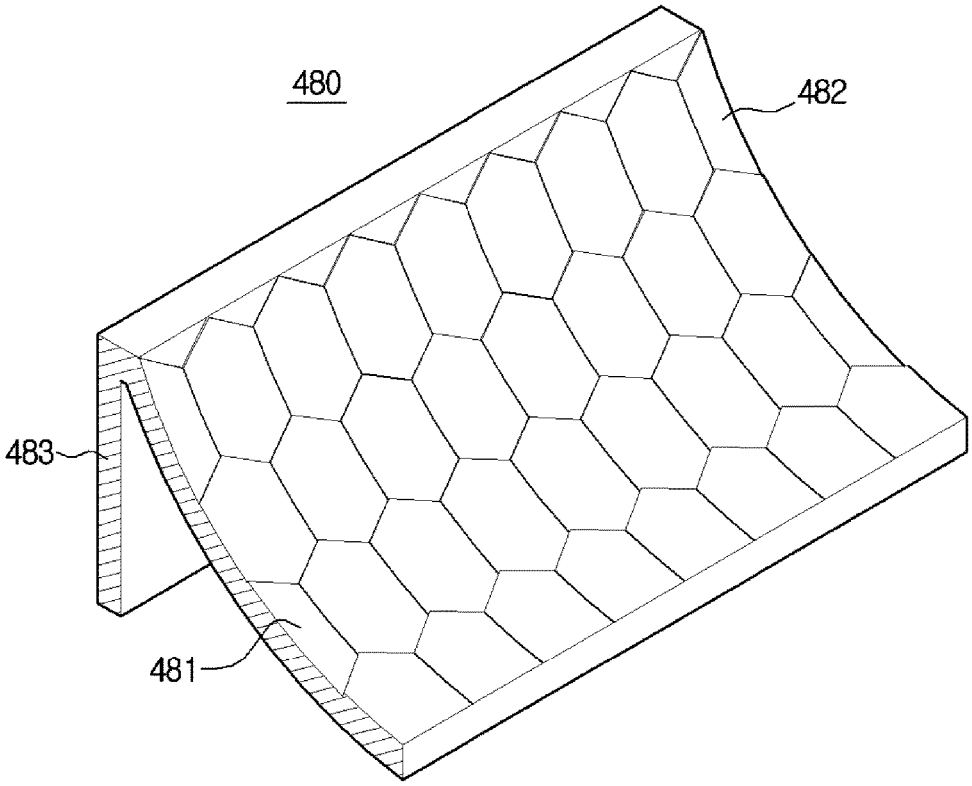
FIG. 30 is a view illustrating a diversion unit according to another embodiment of the present disclosure.

FIGS. 29 and 30 are views illustrating a cross-section of a diversion unit according to various other embodiments of the present disclosure.

As shown in FIGS. 29 and 30, concave portions 471 and 481 of diversion units 470 and 480 may be provided with patterns 472 and 482 of various shapes. For example, according to one embodiment illustrated in FIG. 28, a scale-shaped pattern 472 may be provided. According to one embodiment illustrated in FIG. 29, a diamond pattern 482 may be provided. Patterns of various shapes as described above may reduce frictional resistance that is produced when the wash water contacts the diversion units 470 and 480 to divert the flow passage. Thereby, weakening spray force may be prevented when the wash water contacts the diversion units 470 and 480. Reference numerals 473 and 483 designate the rear walls of the diversion units 470 and 480.

Figure 31:
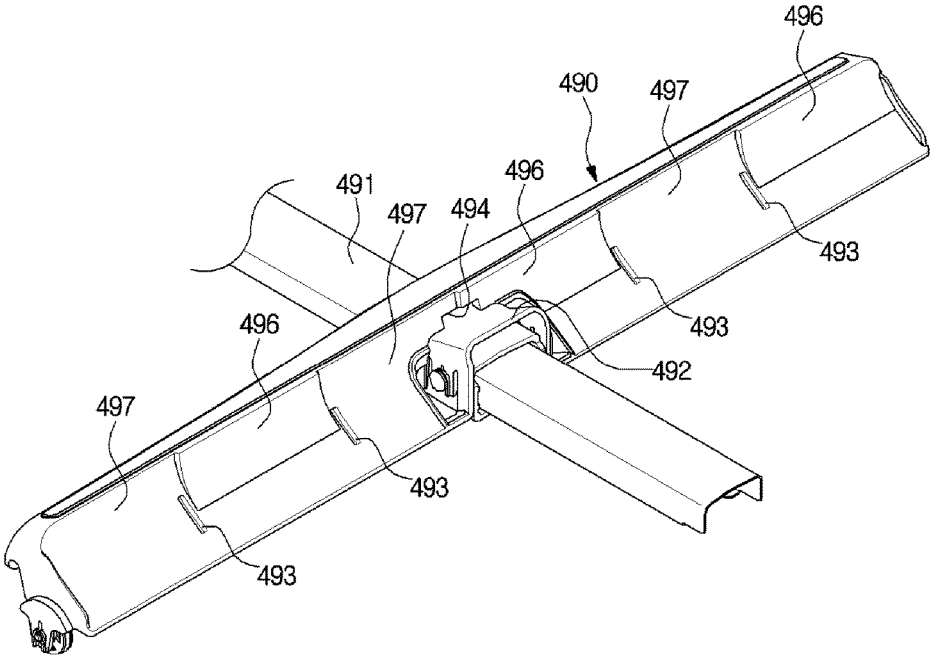
FIG. 31 is a view illustrating a diversion unit according to another embodiment of the present disclosure.

FIG. 31 is a view illustrating a diversion unit according to another embodiment of the present disclosure.

As shown in FIG. 31, a diversion unit 490 may be provided with at least one slit 493, 494. The diversion unit 490 may be provided with a first step portion 496 and a second step portion 497. Referring to FIG. 31, the diversion unit 490 is provided with four first slits 493 and one second slit 494. However, embodiments of the present disclosure are not limited thereto. The first slits 493 may be arranged in the direction in which the wash water is introduced and discharged, and the second slit 494 may be arranged perpendicular to the first slits 493. The second slit 494 may be provided to a surface that contacts the holder 492.

At least one of the first slits 493 and the second slit 494 may be provided. In addition, while four first slits 493 are illustrated as being provided, embodiments of the present disclosure are not limited thereto. At least one of the first slits 493 and the second slit 494 may be provided to at least one portion of the diversion unit 490.

The wash water sprayed from the spray unit 110 (see FIG. 27) may flush the diversion unit 490, passing through the slits 493 and 494 of the diversion unit 490. Thereby, the diversion unit 490 may divert the wash water without being contaminated by contaminants from the dishes. Therefore, contamination of the diversion unit 490 may be minimized during washing of the dishes. After passing through the slits 493 and 494, the wash water may also wash the guide member 491 under the diversion unit 490.

The contaminants produced during washing of the dishes may be discharged from the diversion unit 490 through the slits 493 and 494, without being accumulated on the diversion unit 490. The first slits 493 may prevent contaminants from being accumulated on the surface of the diversion unit 490. The second slit 494 allows contaminants accumulated on the guide member 491 to be discharged through the second slit 494. During washing of the dishes through the slits 493 and 494, the diversion unit 490 and a guide unit 491 are also flushed by wash water, while contaminants are discharged through the slits 493 and 494. Accordingly, accumulation of contaminants on the diversion unit 490 and the guide unit 491 may be prevented.

Figure 32:
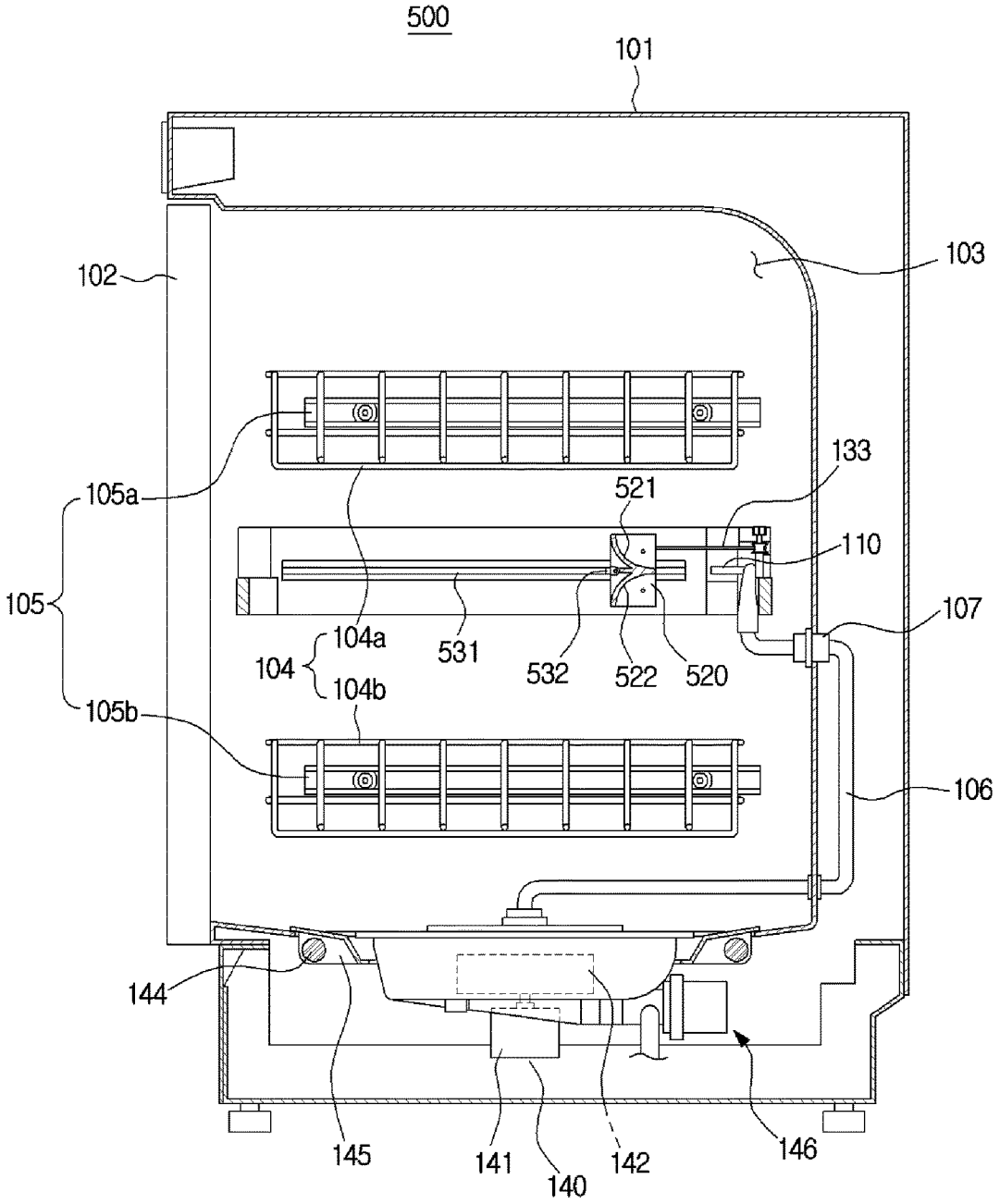
FIG. 32 is a cross-sectional view illustrating the configuration of a dish washing machine according to another embodiment of the present disclosure.

FIG. 32 is a cross-sectional view illustrating the configuration of a dish washing machine 500 according to another embodiment of the present disclosure.

Referring to FIG. 32, a diversion unit 520 may be positioned at the upper side of the dish basket 104. Thereby, the rack 105 and drive units 531 and 532 may also be positioned at the upper side of the dish basket 104. According to one embodiment illustrated in FIG. 30, a plurality of concave portions 521 and 522 may be provided to the diversion unit 520. An upper concave portion 521 positioned at the upper side is formed to be concave up in order to divert the flow passage of the wash water sprayed from the spray unit 110 to the upper dish basket 104*a*. A lower concave portion 522 positioned at the lower side is formed to be concave down in order to divert the flow passage of the wash water sprayed from the spray unit 110 to the lower dish basket 104*b*. As described above, the diversion unit may be positioned at the upper, lower, left or right side of the dish basket to divert the flow passage of the wash water.

Figure 33:
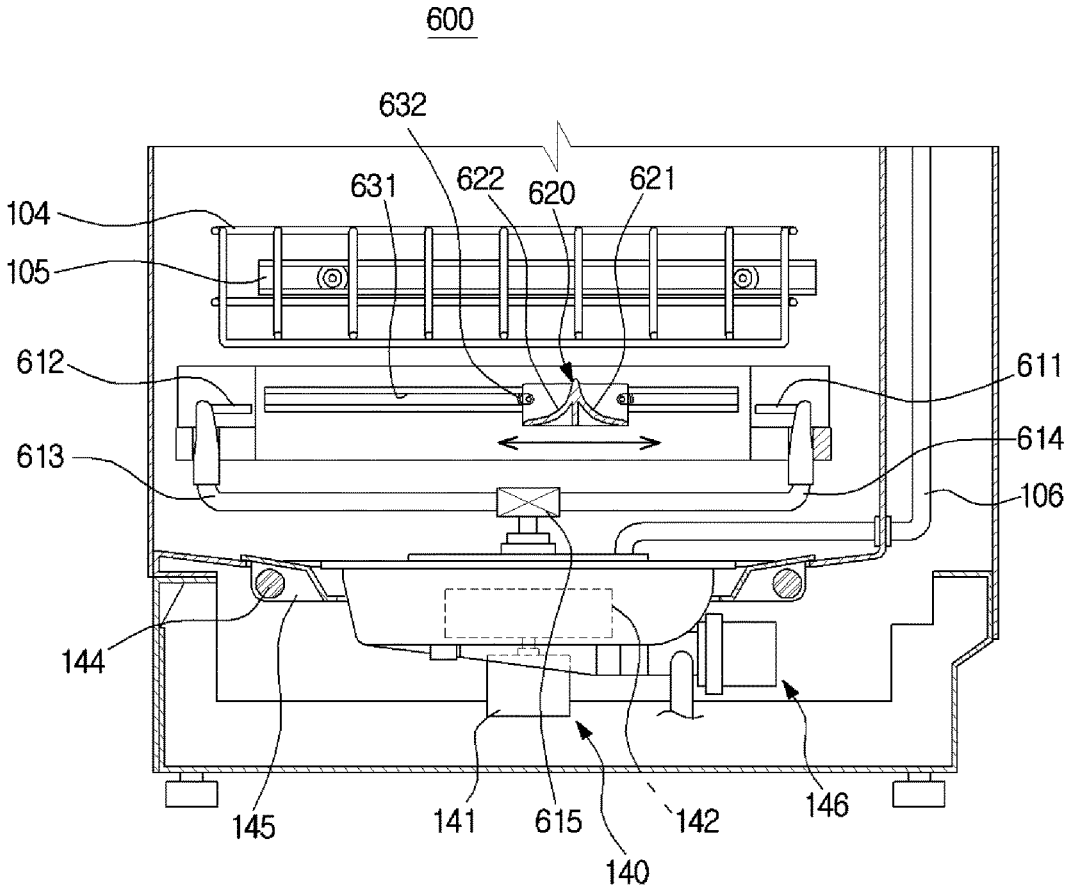
FIG. 33 is a view illustrating a portion of a dish washing machine according to another embodiment of the present disclosure.

FIG. 33 is a view illustrating a portion of a dish washing machine 600 according to another embodiment of the present disclosure.

Referring to FIG. 33, spray units 611 and 612 may be arranged at the inner side of the washing tub to face each other. A diversion unit 620 is provided in the direction of and inside the flow passage of wash water sprayed from the spray units 611 and 612. A plurality of concave portions 621 and 622 is arranged to face the spray units 611 and 612 to divert the wash water sprayed from the spray units 611 and 612.

A first spray unit 611 is arranged to face the first concave portion 621. Thereby, the wash water sprayed from the first spray unit 611 is diverted to the dish basket 104 by the first concave portion 621. A second spray unit 612 is arranged to face the second concave portion 622. Thereby, the wash water sprayed from the second spray unit 612 is diverted toward the dish basket 104 by the second concave portion 622.

As in the illustrated embodiment, the diversion unit 620 may be driven by the power generating unit along guide member 631 and rollers 632. However, embodiments of the present disclosure are not limited thereto. The diversion unit 620 may be moved by the wash water sprayed from the spray units 611 and 612. That is, the diversion unit 620 may be moved toward the second spray unit 612 by the wash water sprayed from the first spray unit 611. The diversion unit 620 may be moved toward the first spray unit 611 by the wash water sprayed from the second spray unit 612. Accordingly, the position of the diversion unit 620 may be determined by the wash water sprayed from the first spray unit 611 and the second spray unit 612. The wash water sprayed toward the first spray unit 611 and the second spray unit 612 may be controlled by a flow passage switching valve 615 connected to first and supply pipes 613 and 614.

The spray units 611 and 612 may be arranged on both surfaces of the washing tub 103 to face each other. In addition, a plurality of diversion units 620 may be provided to face the spray units 611 and 612. Thereby, movement of the diversion units 620 may be controlled by the spray pressure of the spray units 611 and 612, without a separate power generating unit.

Figure 34:
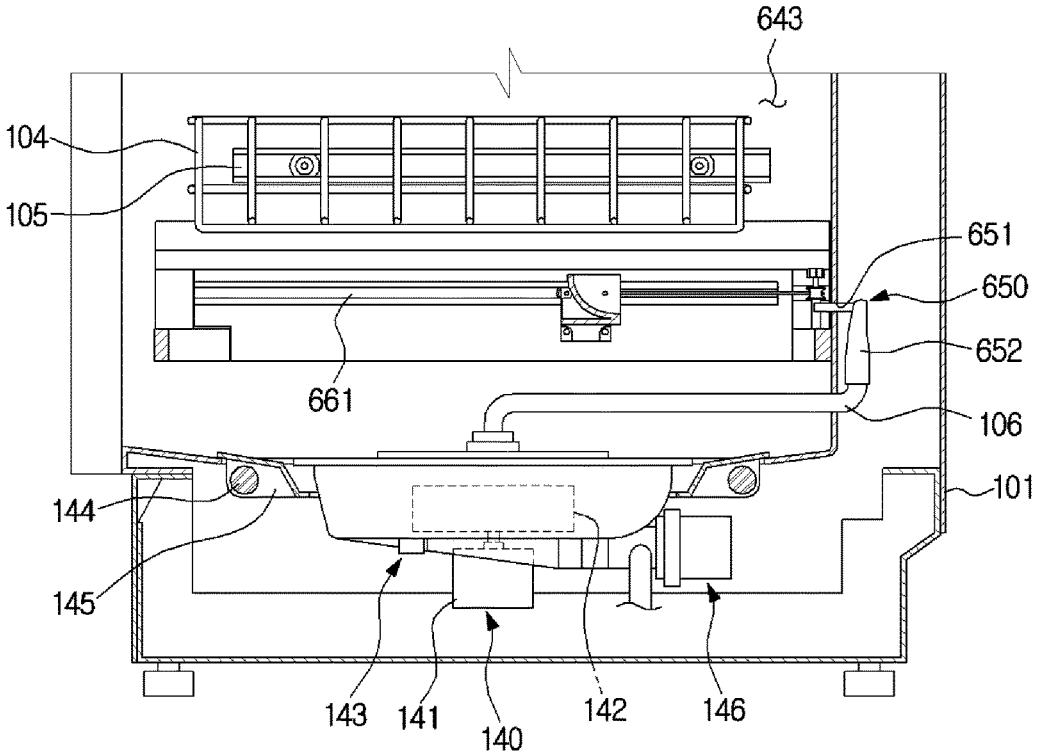
FIG. 34 is a view illustrating a portion of a dish washing machine according to another embodiment of the present disclosure.

FIG. 34 is a view illustrating a portion of a dish washing machine according to another embodiment of the present disclosure.

As shown in FIG. 34, at least one portion of a spray unit 650 may be positioned outside a washing tub 643. That is, only a part of the head 651 of the spray unit 650 may be positioned inside the washing tub 643, and a body 652 of the spray unit 650 may be positioned outside the washing tub 643. At least one portion of the spray unit 650 may be positioned in the space between the washing tub 643 and the cabinet 101. Since only the head 651 of the spray unit 650 is positioned inside the washing tub 643, the space through which wash water is sprayed may be widened. Thereby, dead zones where wash water is not sprayed may be prevented from being produced.

Like other embodiments, the embodiment illustrated in FIG. 34 includes a dish basket 104, a diversion unit 660 positioned at the lower side of the dish basket 104, and a guide member 661 to move the diversion unit 660. The reference numerals in this embodiment which are the same as those in the previous embodiments represent the same configurations as those in the previous embodiments.

Figure 35:
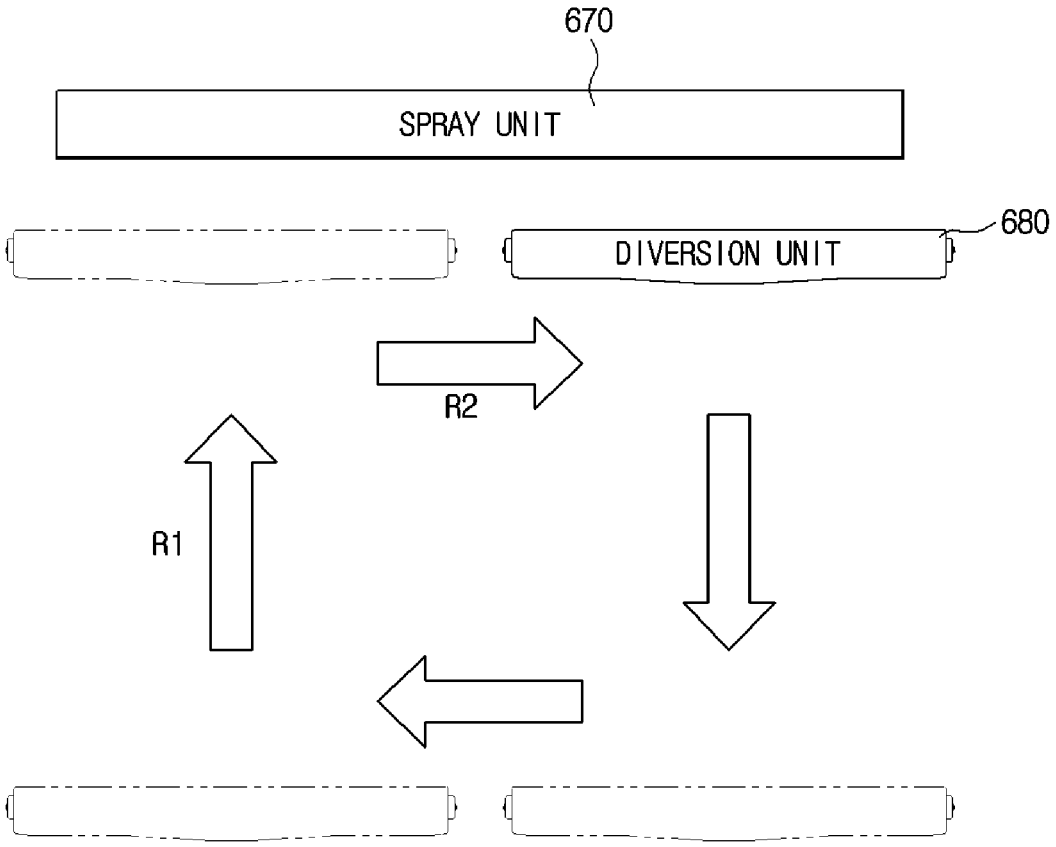
FIG. 35 is a view schematically illustrating movement of a diversion unit of a dish washing machine according to another embodiment of the present disclosure.
Figure 36:
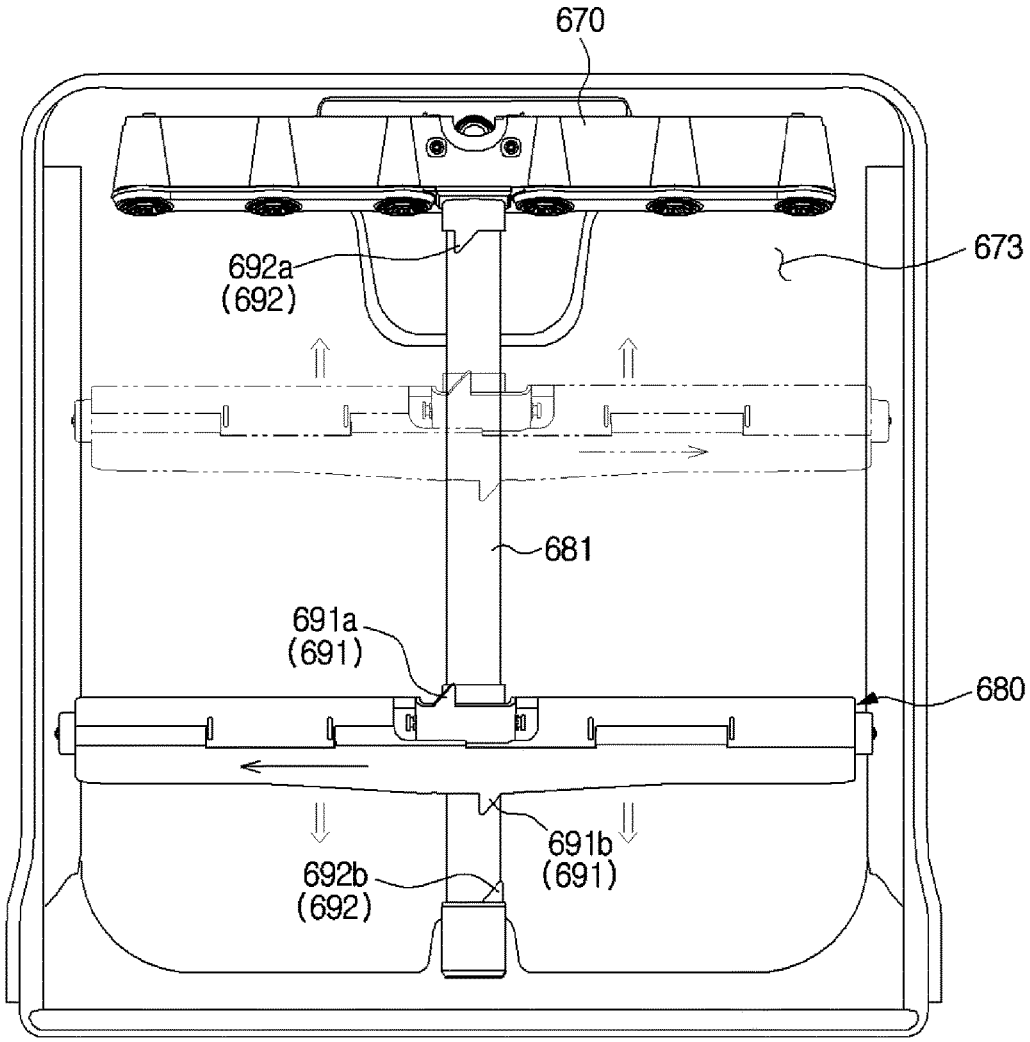
FIG. 36 is a view specifically illustrating the diversion unit shown in FIG. 35.
Figure 37:
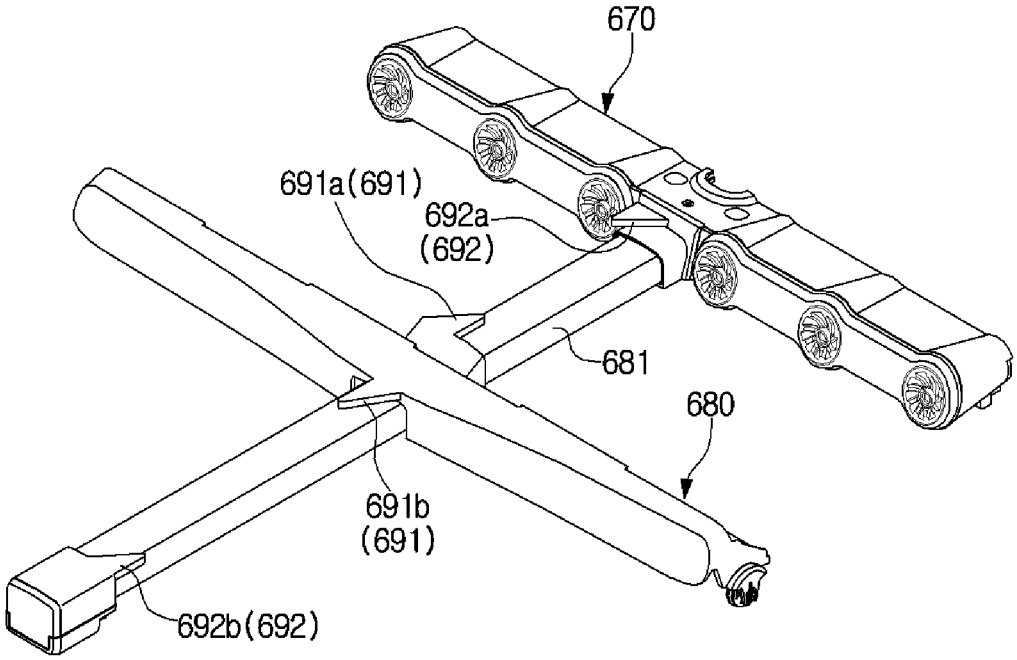
FIG. 37 is a view illustrating the diversion unit of FIG. 36 shown from different angle.

FIG. 35 is a view schematically illustrating movement of a diversion unit of a dish washing machine according to another embodiment of the present disclosure, FIG. 36 is a view specifically illustrating the diversion unit shown in FIG. 35, and FIG. 37 is a view illustrating the diversion unit of FIG. 36 shown from different angle.

As shown in FIGS. 35 to 37, a diversion unit 680 may not only reciprocate in a washing tub 673, but also move along a certain path. That is, the diversion unit 680 may be arranged to move in a first direction R1 and a second direction R2 different from the first direction R1. Referring to FIG. 35, the diversion unit 680 may move, forming a rectangular closed loop. Specific examples of this case are illustrated in FIGS. 36 and 37.

To move the diversion unit 680 as shown in FIG. 35, a guide member 681 to move the diversion unit 680 in the first direction R1 and direction switching members 691 and 692 to move the diversion unit 680 in the second direction R2 are needed. According to one embodiment, the direction switching members 691 and 692 may include first direction switching members 691*a* and 691*b* formed in the shape of a wedge at both sides of the diversion unit 680 and second direction switching members 692*a* and 692*b* formed in a shape corresponding to the shape of the first direction switching members 691*a* and 691*b*. According to one embodiment, one of the second direction switching members 692*a* and 692*b* may be provided to the spray unit 670, and the other one may be provided to one side of the guide member 680, which is provided at the opposite side to the spray unit 670. One of the first direction switching members 691*a* and 691*b* may be arranged to face the spray unit 670, and the other one may be provided at the opposite side to the spray unit 670.

When the diversion unit 680 moves with respect to the guide member 681 and thus the first direction switching members 691*a* and 691*b* contact the second direction switching members 692*a* and 692*b*, the diversion unit 680 may move with respect to the guide member 681 in the second direction R2, according to the shape of second direction switching members 692*a* and 692*b*. Movement caused by the direction switching members 691 and 692 in moving the diversion unit 680 toward the spray unit 670 and the movement caused by the direction switching members 691 and 692 in moving the diversion unit 680 away from the spray unit 670 are produced in the opposite directions. That is, when the diversion unit 680 moves toward the spray unit 670 and thus the first direction switching member 691*a* contacts the second direction switching member 692*a*, the diversion unit 680 moves to the left. When the diversion unit 680 moves away from the spray unit 670 and thus the first direction switching members 691*b* and the second direction switching members 692*b* contact each other, the diversion unit 680 may move to the right.

As described above, the direction switching members 691 and 692 may allow the diversion unit 680 to move to form various different closed loops. Alternatively, by forming a direction switching members to push the guide member 681, the guide member 681 may be moved to the second direction R2 to form a closed loop.

Figure 38:
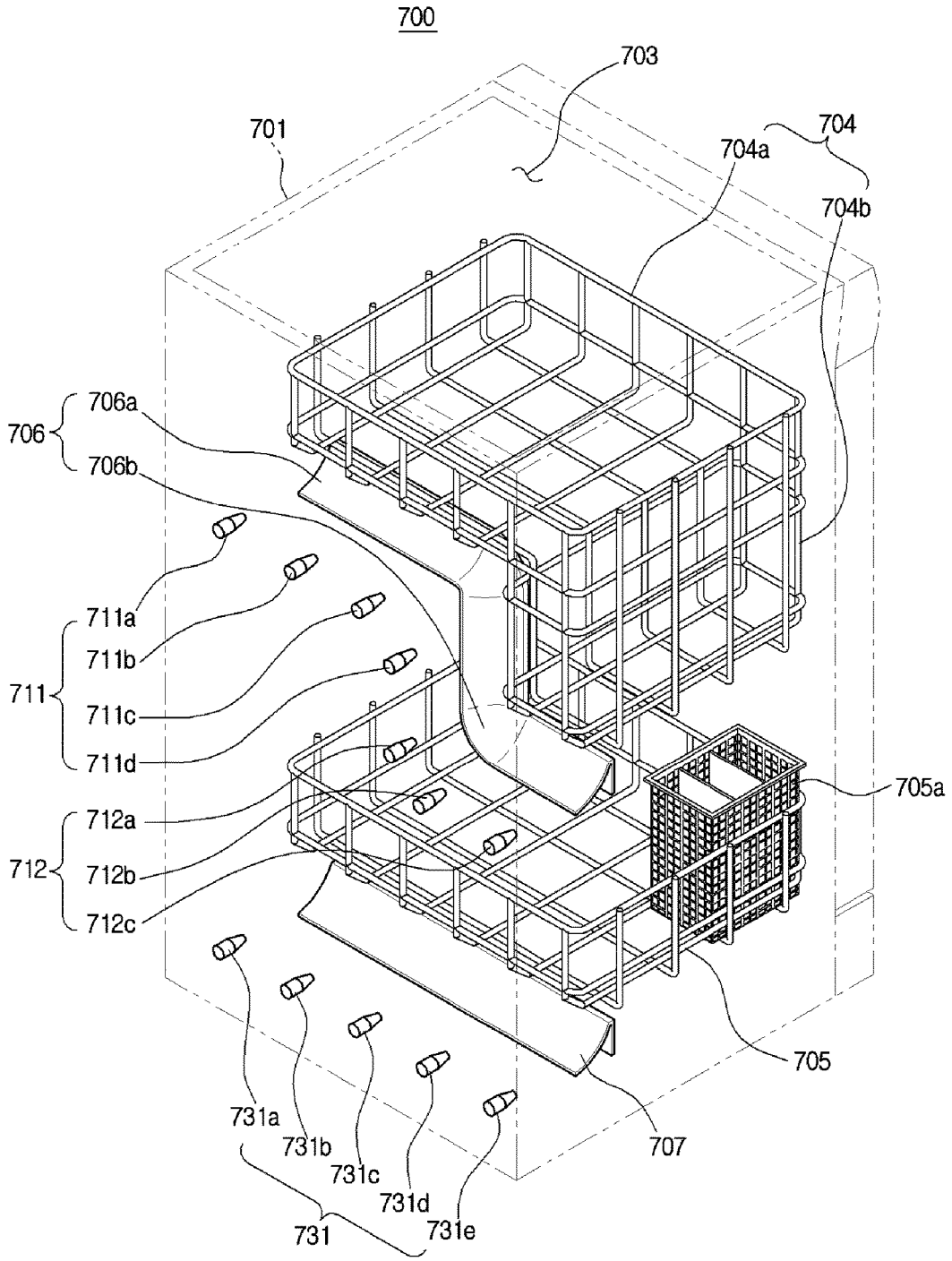
FIG. 38 is a view illustrating a portion of a dish washing machine according to another embodiment of the present disclosure.

FIG. 38 is a view illustrating a portion of a dish washing machine according to another embodiment of the present disclosure.

According to one embodiment illustrated in FIG. 38, a dish washing machine 700 includes an upper dish basket 704 and a lower dish basket 705. The upper dish basket 704 may include a first dish accommodation portion 704*a* and a second dish accommodation portion 704*b*. The first dish accommodation portion 704*a* and the second dish accommodation portion 704*b* may have different heights to efficiently accommodate different kinds of dishes.

An upper diversion unit 706 may be arranged according to the shape of the lower surface of the upper dish basket 704. In the example shown in FIG. 38, the upper diversion unit 706*a* and 706*b* is positioned at the lower side of the upper dish basket 704, and is thus arranged according to the shape of the lower surface of the upper dish basket 704. However, embodiments of the present disclosure are not limited thereto. In the case that the diversion unit is positioned at the upper side of the dish basket, the diversion unit may be arranged according to the shape of the upper surface of the dish basket. That is, the diversion unit is arranged according to the shape of one surface of a dish basket close to the diversion unit. Thereby, the upper spray unit may include a plurality of head groups 711 and 712. The first head group 711 may be positioned to correspond to the first dish accommodation portion 704*a* and include a plurality of heads 711*a*, 711*b*, 711*c* and 711*d*. The second head group 712 may be positioned to correspond to the second dish accommodation portion 704*b* and include a plurality of heads 712*a*, 712*b* and 712*c*.

The lower dish basket 705 may be provided with a spoon and chopsticks container 705*a* for accommodation of spoons and chopsticks at one side thereof. A lower diversion unit 707 corresponding to the lower dish basket 705 and a lower spray unit 731 to spray wash water toward the lower diversion unit 707 are provided. The lower spray unit 731 may include a plurality of heads 731*a*, 731*b*, 731*c*, 731*d* and 731*e*.

The diversion units 706 and 707 may be formed in various shapes according to the shapes of the dish baskets 704 and 705, thereby efficiently diverting wash water to the dish baskets.

In addition, the shapes of the respective regions constructing the diversion units 706 and 707 may vary depending upon the distance between wires or frames formed at the dish baskets 704 and 705 or the kinds of dishes accommodated in the dish baskets 704 and 705. Depending upon the kinds of dishes accommodated in the dish baskets 704 and 705, the distance between wires of the dish baskets may vary between the dish baskets as shown in FIG. 38. That is, large dishes may be accommodated in the dish basket 705 having wires spaced a long distance from each other, while small tableware such as spoons and chopsticks may be accommodated in a spoon and chopsticks container having wires spaced a short distance from each other. Depending upon the distance between the wires, the shape of the diversion units 706 and 707 corresponding to the dish baskets 704 and 705 and the curvature of the concave portion may vary.

Figure 39:
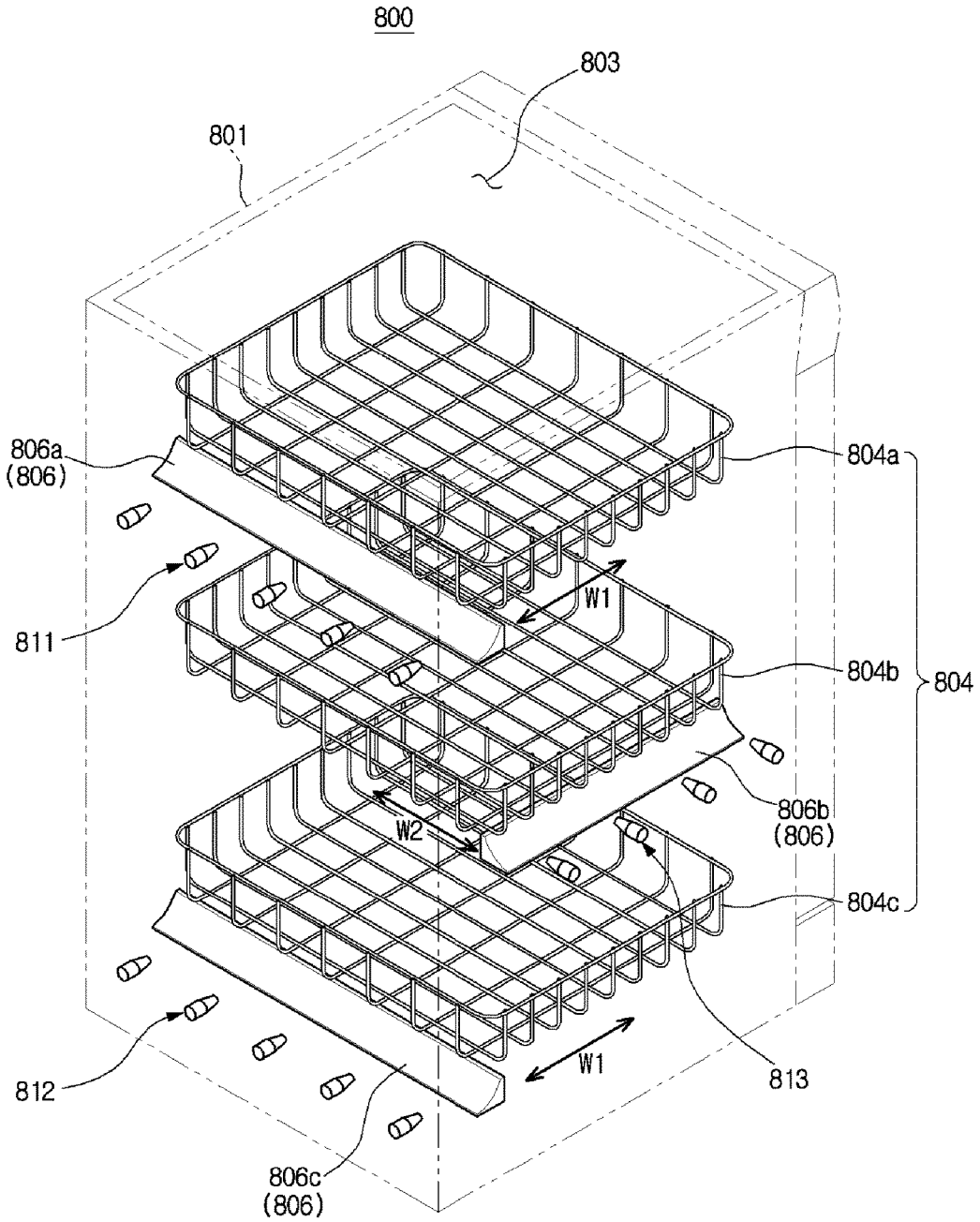
FIG. 39 is a view illustrating a portion of a dish washing machine according to another embodiment of the present disclosure.

FIG. 39 is a view illustrating a portion of a dish washing machine according to another embodiment of the present disclosure.

According to one embodiment illustrated in FIG. 39, a dish washing machine 800 is provided with a washing tub 803, in which the dishes are washed, in a cabinet 801 forming the external appearance of the dish washing machine 800.

The dish washing machine 800 includes dish baskets 804. The dish basket 804 includes an upper dish basket 804*a*, a middle dish basket 804*b*, and a lower dish basket 804*c*. A diversion unit 806 may be positioned at the lower end of each of the dish baskets 804.

According to one embodiment, a diversion unit 806*a* positioned at the lower end of the upper dish basket 804*a* may move in direction w1. Herein, movement in the direction w1 represents movement between the front surface and rear surface of the washing tub 803 when one surface of the dish washing machine 800 provided with a door is defined as the front surface, and the surface opposite to the front surface is defined as the rear surface. The diversion unit 806*c* of the lower dish basket 804*c* may also move in the direction w1.

A diversion unit 806*b* positioned at the lower end of the middle dish basket 804*b* may move in direction w2. Herein, movement in the direction w2 represents movement between both side surfaces of the washing tub 803. That is, the direction w2 is perpendicular to the direction w1.

Spray units 811, 812 and 813 are positioned to respectively spray water toward the diversion units 806. The upper spray unit 811 and the lower spray unit 812 may be positioned on the front surface or rear surface of the washing tub 803 to spray wash water toward the upper diversion unit 806*a* and the lower diversion unit 806*c*. According to the illustrated embodiment, the upper spray unit 811 and the lower spray unit 813 are positioned on the rear surface of the washing tub 803. However, embodiments of the present disclosure are not limited thereto.

To spray wash water toward the diversion unit 806*b* moving in the direction w2, the middle spray unit 813 may be positioned on a side surface of the washing tub 803.

According to the illustrated embodiment, only the middle diversion unit 806*b* may move in the direction w2. Embodiments of the present disclosure are not limited thereto. The dish washing machine may be configured such that the upper diversion unit 806*a* and the lower diversion unit 806*c* may also move in the direction w2.

Figure 40:
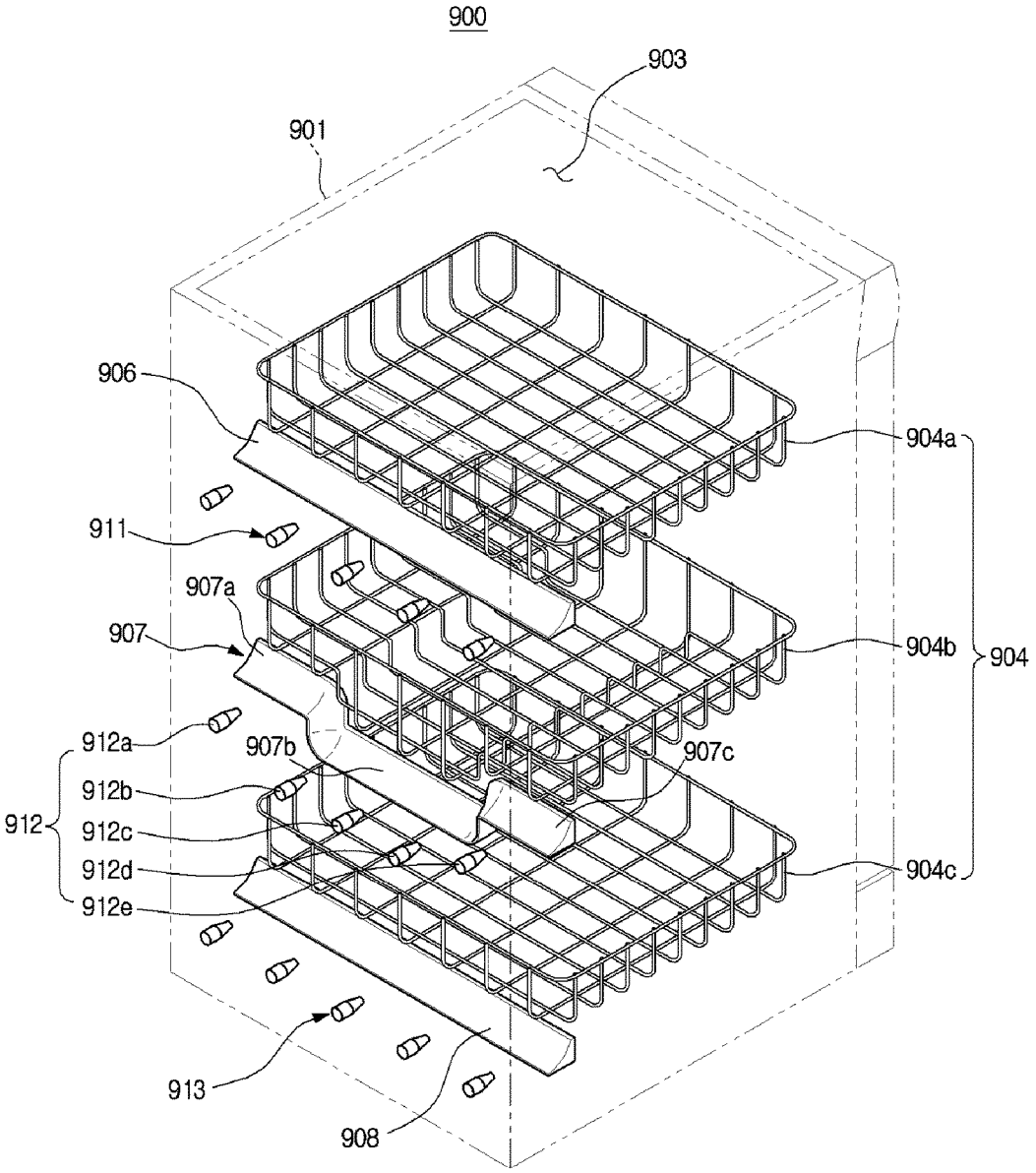
FIG. 40 is a view illustrating a portion of a dish washing machine according to another embodiment of the present disclosure.

FIG. 40 is a view illustrating a portion of a dish washing machine according to another embodiment of the present disclosure.

As shown in FIG. 40, a dish washing machine 900 may include a cabinet 901 forming an external appearance of the dish washing machine 900 and a washing tub 903 provided in the cabinet 901.

The dish washing machine 900 includes a dish basket 904. The dish basket 904 includes an upper dish basket 904*a*, a middle dish basket 904*b*, and a lower dish basket 904*c*. Diversion unit 906, 907 and 908 may be positioned at lower ends of the dish baskets 904.

According to one embodiment, the center portion of the lower end of the middle dish basket 904*b* protrudes. Thereby, the diversion unit 907 positioned at the lower end of the middle dish basket 904*b* is also formed in a shape corresponding to that of the middle dish basket 904*b*. The middle diversion unit 907 may include a protrusion 907*b* having a protruding lower end. According to one embodiment of the present disclosure, the protrusion 907*b* may be provided to the middle portion of the diversion unit 907, and both ends 907*a* and 907*c* of the diversion unit 907 may be positioned at a higher level than the protrusion 907*b* to correspond to the shape of the middle dish basket 904*b*.

Spray units 911, 912 and 913 may include an upper spray unit 911, a middle spray unit 912, and a lower spray unit 913. The middle spray unit 912 may be formed in the shape corresponding to the shape of the middle diversion unit 907 to spray wash water onto the middle diversion unit 907. Thereby, heads 912*a*, 912*b*, 912*c*, 912*d* and 912*e* constructing the middle spray unit 912 may be positioned at different levels to correspond to the shape of the middle diversion unit 907. According to one embodiment of the present disclosure, the heads 912*b*, 912*c* and 912*d* corresponding to the protrusion 907*b* may be positioned lower than the heads 912*a* and 912*e* corresponding to the both ends 907*a* and 907*c*.

Since the middle diversion unit 907 is formed in a shape corresponding to the shape of the middle end dish basket 904*b*, wash water may be efficiently sprayed onto the middle end dish basket 904*b* without separately adjusting the height of the diversion unit 907.

In addition, since the protrusion 907*b* is provided to the middle portion of the diversion unit 907 and further recessed than both ends 907*a* and 907*c* of the protrusion 907*b*, a detergent may be positioned at the protrusion 907*b*. Thereby, when wash water sprayed from the middle spray unit 912 contacts the detergent, the wash water and the detergent are mixed together, and thus the dishes may be washed by the mixture of the wash water and the detergent.

As is apparent from the above description, a dish washing machine according to an embodiment of the present disclosure includes a diversion unit in addition to a spray unit, and therefore a dead zone which wash water does not reach may be eliminated. In addition, spray efficiency may be increased by setting the spray pattern of the wash water to be linear according to reciprocation of the diversion unit. Further, divided and intensive washing may be implemented in the washing tub by controlling the position of the diversion unit. In addition, since pressure loss in the flow passage is low, energy may be saved and washing efficiency may be increased.

Although a few embodiments of the present disclosure have been shown and described, it would be appreciated by those skilled in the art that changes may be made to the embodiments without departing from the principles and spirit of the invention, the scope of which is defined in the claims and their equivalents.

What is claimed is:

1. A dish washing machine comprising:

a cabinet forming an external appearance of the dish washing machine;

a washing tub arranged in the cabinet and allowing dishes to be washed therein;

a dish basket arranged in the washing tub to accommodate the dishes;

a guide member extending across a bottom surface of the washing tub such that the bottom surface of the washing tub is divided by the guide member into a first region and a second region;

at least one spray unit comprising a first head group and a second head group, each having a plurality of heads spaced apart from each other to spray wash water inside the washing tub in a first direction, wherein the first head group is disposed above the first region and the second head group is disposed above the second region;

a diversion unit coupled to the guide member to move in the first direction and a second direction opposite to the first direction, separated from the at least one spray unit, extended from the first region to the second region, and arranged to face the at least one spray unit to divert the wash water sprayed from the at least one spray unit toward the dish basket; and a flow passage switching valve to selectively supply the wash water to at least one of the first head group and the second head group.

2. The dish washing machine according to claim 1, wherein the diversion unit is arranged at at least one of upper, lower and lateral sides of the dish basket to divert the wash water sprayed from the at least one spray unit toward the dish basket.

3. The dish washing machine according to claim 1, wherein the flow passage switching valve comprises a base and a plurality of holes formed in the base, wherein whether to open or close a flow passage is determined according to positions of the holes shifted by rotation of the base to selectively supply the wash water to at least one of the first head group and the second head group.

4. The dish washing machine according to claim 1, wherein the diversion unit comprises at least one concave portion provided to at least one portion of a surface of the diversion unit contacting the wash water sprayed from the at least one spray unit, the concave portion being concavely formed to divert the wash water toward the dish basket.

5. The dish washing machine according to claim 4, wherein the diversion unit further comprises a flat surface.

6. The dish washing machine according to claim 4, wherein the diversion unit comprises a plurality of concave portions causing the wash water to be sprayed at different angles.

7. The dish washing machine according to claim 4, wherein the concave portion comprises an introduction portion allowing the wash water to be introduced thereinto and a discharge portion allowing the wash water to be sprayed therefrom, wherein the discharge portion comprises a first step portion and a second step portion, the first step portion and the second step portion being stepped with respect to each other.

8. The dish washing machine according to claim 4, wherein the at least one spray unit comprises the plurality of heads to spray the wash water, and the concave portion comprises at least two regions corresponding to the plurality of heads, and wherein each of the at least two regions is formed to have a different curvature such that the wash water is discharged at a different angle.

9. The dish washing machine according to claim 1, wherein at least one portion of the diversion unit is provided with at least one slit to prevent contaminants from being accumulated on the diversion unit.

10. The dish washing machine according to claim 1, wherein the guide member is coupled to the diversion unit to support a center portion of the diversion unit.

11. The dish washing machine according to claim 10, wherein a balancing member to prevent the diversion unit from being rocked is coupled to both lateral sides of the diversion unit.

12. The dish washing machine according to claim 1, further comprising a holder disposed between and coupled to the diversion unit and the guide member to guide coupling between the diversion unit and the guide member.

13. The dish washing machine according to claim 1, wherein a lower surface of the guide member is provided with an opening to prevent accumulation of contaminants.

14. The dish washing machine according to claim 1, further comprising a catch member positioned at one side of the washing tub, the catch member contacting and rotating the diversion unit to change an angle of spray of the wash water.

15. The dish washing machine according to claim 1, further comprising a direction switching member to switch movement of the diversion unit between the first direction and the second direction.

16. The dish washing machine according to claim 1, further comprising a power generating unit to drive the diversion unit to move within the washing tub.

17. The dish washing machine according to claim 1, wherein the at least one spray unit is fixed to at least one of inner wall surfaces of the washing tub.

18. The dish washing machine according to claim 1, wherein the at least one spray unit comprises the plurality of heads and a body extending from the plurality of heads, the body being positioned between the washing tub and the cabinet.

19. The dish washing machine according to claim 1, wherein the wash water is sprayed from the first head group and the second head group such that at least one of spray pressure, wash water temperature and spray time is different between the first head group and the second head group.

20. The dish washing machine according to claim 1, wherein each of the plurality of heads is inclined upward such that the wash water is sprayed by a predetermined distance.

* * * * *